US006573874B1

(12) United States Patent
Saito et al.

(10) Patent No.: US 6,573,874 B1
(45) Date of Patent: Jun. 3, 2003

(54) ANTENNA AND RADIO DEVICE

(75) Inventors: Yutaka Saito, Ishikawa (JP); Hiroshi Haruki, Yokohama (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/890,396

(22) PCT Filed: Dec. 2, 1999

(86) PCT No.: PCT/JP99/06780

§ 371 (c)(1),
(2), (4) Date: Jul. 30, 2001

(87) PCT Pub. No.: WO01/41254

PCT Pub. Date: Jun. 7, 2001

(30) Foreign Application Priority Data

Jun. 4, 1998 (JP) ..... 1-170540

(51) Int. Cl.[7] ..... H01Q 9/44; H01Q 9/16
(52) U.S. Cl. ..... 343/805; 343/733; 343/806
(58) Field of Search ..... 343/700 MS, 733, 343/767, 770, 795, 805, 806

(56) References Cited

U.S. PATENT DOCUMENTS

| | | | | | |
|---|---|---|---|---|---|
| 2,283,938 | A | * | 5/1942 | McKesson | 343/733 |
| 4,719,470 | A | * | 1/1988 | Munson | 343/700 MS |
| 4,775,866 | A | * | 10/1988 | Shibata et al. | 343/700 MS |
| 5,220,335 | A | * | 6/1993 | Huang | 343/700 MS |
| 5,404,146 | A | * | 4/1995 | Rutledge | 343/770 |
| 6,031,503 | A | * | 2/2000 | Preiss, II et al. | 343/770 |

FOREIGN PATENT DOCUMENTS

| | | | |
|---|---|---|---|
| JP | 5-259733 | 10/1993 | H01Q/19/10 |
| JP | 5-267932 | 10/1993 | H01Q/21/28 |
| JP | 6-44219 | 2/1994 | G06F/15/20 |
| JP | 6-104627 | 4/1994 | H01Q/1/38 |
| JP | 6-268432 | 9/1994 | H01Q/7/00 |
| JP | 6-334434 | 10/1994 | H01Q/21/24 |
| JP | 8-139521 | 5/1996 | H01Q/21/28 |
| JP | 8-304433 | 11/1996 | G01P/3/488 |
| JP | 9-232851 | 9/1997 | H01Q/9/20 |

OTHER PUBLICATIONS

"Antenna Handbook", CQ Publication Co., Ltd.; p. 366; Cited in Specification.
John D. Kraus: "Antennas" Second Edition, US, MacGraw–Hill, 1988; p. 509–510, Fig. 11–58(d).
Antenna Kougaku Handbook, Denshi Tsushin Gakkai ed., Japan, Kabushiki Kaisha Omusha, Oct. 7, 1984, p. 139.
John D. Kraus: "Antennas" Second Edition, US, MacGraw–Hill, 1988; p. 732–733, Fig. 16–20(b).
John D. Kraus: "Antennas" Second Edition, US, MacGraw–Hill, 1988; p. 479–481, Fig. 11–39, 11–41(a).
John D. Kraus: "Antennas" Second Edition, US, MacGraw–Hill, 1988; p. 641, Fig. 13–17(c).

* cited by examiner

*Primary Examiner*—Hoang Nguyen
(74) *Attorney, Agent, or Firm*—Pearne & Gordon LLP

(57) ABSTRACT

Two one-wavelength antenna elements (1) and (2) arranged in diamond-wise opposition to each other so that one-ends of the antenna elements (1) and (2) are provided with a feeding portion (3) and the other-ends (4) of the same are opened, and so that the angle ($\alpha$) of each of bent portions (1*a*) and (2*a*) in the centers of the antenna elements (1) and (2) respectively is selected to be an optimal angle to obtain optimal radiation directivity with a simple configuration, thereby obtaining an antenna device which has a high gain. Accordingly, a small-size and low-profile antenna device can be obtained as a mobile communication antenna in UHF and submicro wave bands.

1 Claim, 22 Drawing Sheets

ANTENNA AND RADIO DEVICE

TECHNICAL FIELD

The present invention relates to an antenna device used in a mobile communication system such as a PHS or the like, and a radio apparatus having the antenna device built therein.

BACKGROUND ART

Heretofore, a high gain was required of an antenna device used in a radio base station apparatus or fixed radio terminal apparatus in a mobile communication system such as PHS or the like. Therefore, a multistage collinear array antenna was used, for example, as shown in JP-A-5-267932, JP-A-9-232851 and JP-A-8-139521. In the antenna of this type, antennas non-directional in a horizontal plane with respect to vertically polarized wave were arranged multistageously vertically to narrow directivity in a vertical plane to thereby secure a high gain.

An end-fire array antenna represented by a Yagi antenna or a reflector-containing dipole antenna was also used, for example, as shown in JP-A-5-259733 and JP-A-8-304433. In the antenna of this type, passive elements were arranged in parallel to the direction of main radiation to thereby secure a high gain.

A broadside array antenna represented by a patch array antenna was further used, for example, as shown in JP-A-6-334434. In the antenna of this type, a plurality of antennas were arranged in a plane perpendicular to the direction of main radiation to perform distributive feeding to thereby secure a high gain.

A low-profile antenna represented by a reflector-containing loop antenna or a slot antenna was further used, for example, as shown in JP-A-6-268432 and JP-U-6-44219.

On the other hand, an antenna formed from two one-wavelength antennas arranged into the form of a square or a circle, for example, as shown in"Antenna Handbook" (CQ Publication Co., Ltd.) p.366 is known as a broadside array antenna mainly used in a VHF band.

In the aforementioned conventional multistageous collinear array antenna, it was however necessary to arrange a large number of antennas vertically multistageously in order to secure a high gain. For example, a height of about 1 m was needed to obtain a gain of 10 dB in a 1900 MHz band. Hence, there was a problem in making sure of the antenna-setting space and mechanical strength. Further, the antenna of this type was unsuitable for being built in a radio apparatus because of its height.

Further, in the aforementioned conventional end-fire array antenna, it was necessary to arrange a large number of antennas in the direction of main radiation in order to secure a high gain. Hence, there was a problem in making sure of the antenna-setting space and mechanical strength. Further, the antenna of this type was unsuitable for being built in a radio apparatus because of its structure.

Further, in the conventional broadside array antenna, it was necessary to arrange a large number of antennas in a plane perpendicular to the direction of main radiation in order to secure a high gain. Hence, the total area of the antenna increased, so that there was a problem in making sure of the antenna-setting space and mechanical strength. Further, the antenna of this type was unsuitable for being built in a radio apparatus because of its large area.

In addition, although the conventional low-profile antenna was formed in a small-size low-profile configuration, there was a problem that the radiation directivity could not be optimized to provide desired characteristic.

In the aforementioned antenna formed from two one-wavelength antennas arranged into the form of a square or a circle, only the radiation directivity in a predetermined vertical plane and in a predetermined horizontal plane could be obtained, and there was a problem that the radiation directivity could not be optimized to provide desired characteristic.

The present invention is designed to solve the conventional various problems generally and it is an object of the present invention to provide an antenna device in which the optimal radiation directivity can be obtained in the broadside array antenna having two one-wavelength antennas, in which a high gain and a high function can be obtained with a simple configuration and which can be used as a small-size low-profile antenna for a mobile communication system in UHF and sub-micro wave bands.

DISCLOSURE OF THE INVENTION

The present invention is devised so that the angle of bending in the center of each one-wavelength antenna element in a broadside array antenna having two one-wavelength antenna elements arranged therein is selected to be an optimal angle. Hence, there can be provided an antenna device in which desired radiation directivity can be obtained with a simple configuration and which has a high gain.

Further, the present invention is devised so that a plurality of antennas are connected in an opening portion at a forward end of each of the aforementioned antennas. Hence, there can be provided an antenna device which has a high gain with a simple planar configuration.

Further, the present invention is devised so that a plurality of antennas are connected in parallel with each other in a feeding portion. Hence, there can be provided an antenna device which has a high gain with a simple planar configuration.

Further, the present invention is devised so that the aforementioned antennas are formed by a pattern printed on a dielectric substrate. Hence, there can be provided an antenna device in which desired directivity can be obtained with a small-size and simple configuration and which has a high gain.

Further, the present invention is devised so that the plurality of antennas are connected to one another through transmission lines each having a predetermined electrical length. Hence, there can be provided an antenna device in which the antenna as a whole can be extended in the Y-plane direction easily, in which desired directivity can be obtained and which has a high gain.

Further, the present invention is devised so that the two pairs of aforementioned antennas are arranged with directions of main polarization perpendicular to each other and so that the antenna devices are fed with phase differences of 90 degrees. Hence, there can be provided an antenna device in which desired radiation directivity can be obtained with a simple planar configuration to achieve a circular polarization antenna having a high gain.

Further, the present invention is devised so that the two pairs of aforementioned antennas are formed by print patterns arranged on opposite surfaces of a dielectric substrate. Hence, there can be provided an antenna device in which desired radiation directivity can be obtained with a small-size and simple planar configuration to achieve a circular polarization antenna having a high gain.

Further, the present invention is devised so that a reflection plate is provided in proximity to the antenna. Hence, there can be provided an antenna device in which desired radiation directivity can be obtained with a simple planar configuration and which has a high gain.

Further, the present invention is devised so that a plurality of passive elements are provided in proximity to the antenna. Hence, there can be provided an antenna device in which desired radiation directivity can be obtained with a simple planar configuration and which has a high gain.

Further, the present invention is devised so that the aforementioned antennas are arranged as a radiator and a reflector while a plurality of wave directors each having a shape similar to that of each of the antennas are arranged in the directions of the main radiation. Hence, there can be provided an antenna device in which desired radiation directivity can be obtained with a simple configuration and which has a high gain.

Further, the present invention is devised so that the two pairs of aforementioned antennas are arranged with the directions of main polarization being made identical with each other and with the directions of main radiation being made different from each other so that the antennas are fed with phase differences of 90 degrees from each other. Hence, there can be provided an antenna device in which desired radiation directivity can be obtained with a simple configuration and which has a high gain.

Further, the present invention is devised so that the two pairs of a fore mentioned antennas are arranged with the directions of the main polarization being made identical with each other and with the directions of the main radiation being made different from each other. Hence, there can be provided an antenna device in which desired radiation directivity can be obtained with a simple configuration and which has a high gain.

Further, the present invention is devised so that the plurality of aforementioned antennas are arranged with the directions of the main polarization being made identical with one another and with the directions of the main radiation being made different from one another, and controlling is performed such that the opposite antenna elements of one or plural antenna devices among the plurality of antenna devices are partially electronically connected to each other. Hence, there can be provided an antenna device in which the radiation directivity can be changed variously with a simple configuration and which has a high gain.

Further, the present invention is devised so that a quarter-wavelength shorting stub is connected to a feeding point so that feeding is performed at a position where the impedance of the shorting stub is optimized. Hence, there can be provided an antenna device in which good impedance matching can be obtained by a small-size matching circuit with a simple configuration and which has a high gain.

Further, the present invention is devised so that an antenna device comprises a first one-wavelength slot element provided in a conductor plate so as to be bent at an angle $\alpha$ in the center of the first slot element, and a second one-wavelength slot element provided in the conductor plate so as to be bent at an angle $\alpha$ in the center of the second slot element, wherein the first and second slot elements are arranged in diamond-wise opposition to each other and wherein respective one-ends of the first and second slot elements are connected to each other to provide a feeding portion at the one-ends. Hence, there can be provided an antenna device to achieve a slot antenna having a high gain with a simple planar configuration.

Further, the present invention is devised so that, in the aforementioned slot antenna, the angle of bending in the center of each of the one-wavelength slot elements is selected to be an optimal angle to obtain optimal radiation directivity. Hence, there can be provided a slot antenna in which optimal radiation directivity can be obtained with a simple planar configuration and which has a high gain.

Further, the present invention is devised so that a plurality of slot antennas as described above are connected in the opening portion at the forward ends of the antennas. Hence, there can be provided an antenna device to achieve a slot antenna having a high gain with a simple planar configuration.

Further, the present invention is devised so that a plurality of slot antennas as described above are connected in parallel to each other at a feeding portion. Hence, there can be provided an antenna device to achieve a slot antenna in which optimal radiation directivity can be obtained with a simple planar configuration and which has a high gain.

Further, the present invention is devised so that the plurality of slot antennas are formed by a print pattern formed on a dielectric substrate. Hence, there can be provided an antenna device to achieve a slot antenna in which optimal radiation directivity can be obtained with a small-size and simple planar configuration and which has a high gain.

Further, the present invention is devised so that a reflection plate is provided in proximity to the slot antenna. Hence, there can be provided an antenna device to achieve a slot antenna in which desired radiation directivity can be obtained with a simple planar configuration and which has a high gain.

Further, the present invention is devised so that a plurality of passive elements are provided in proximity to the slot antenna. Hence, there can be provided an antenna device to achieve a slot antenna in which desired radiation directivity can be obtained with a simple configuration and which has a high gain.

Further, the present invention is devised so that the aforementioned antenna device is built in a radio apparatus. Hence, there can be provided a radio apparatus with a built-in antenna in which desired radiation directivity can be obtained and which has a high gain with a small-size and simple configuration.

Further, the present invention is devised so that a plurality of antenna devices as described above are arranged to form a sector antenna device for a radio base station. Hence, there can be provided an antenna device to achieve a diversity antenna or a sector antenna in which desired radiation directivity can be obtained with a small-size and simple configuration and which has a high gain.

Further, the present invention is devised so that a reflection plate is provided to be used in common to the plurality of antenna devices. Hence, there can be provided an antenna device to achieve a diversity antenna or a sector antenna in which desired radiation directivity can be obtained with a small-size and simple configuration and which has a high gain.

Further, the present invention is devised so that a plurality of antennas as described above are arranged to form a sector antenna device for a radio base station, and so that the sector antenna device is provided in the radio base station. Hence, there can be provided a radio base station with a built-in diversity or sector antenna in which desired radiation directivity can be obtained with a small-size and simple configuration and which has a high gain.

Further, the present invention is devised so that each of two antenna elements arranged diamond-wise is bent at an angle a in its center, and so that the angle α is selected to be an angle at which optimal radiation directivity can be obtained. Hence, there can be provided a method of controlling the directional gain of an antenna in which desired radiation directivity can be obtained with a simple planar configuration and which has a high gain.

BEST MODE FOR CARRYING OUT THE INVENTION

Figure 1:
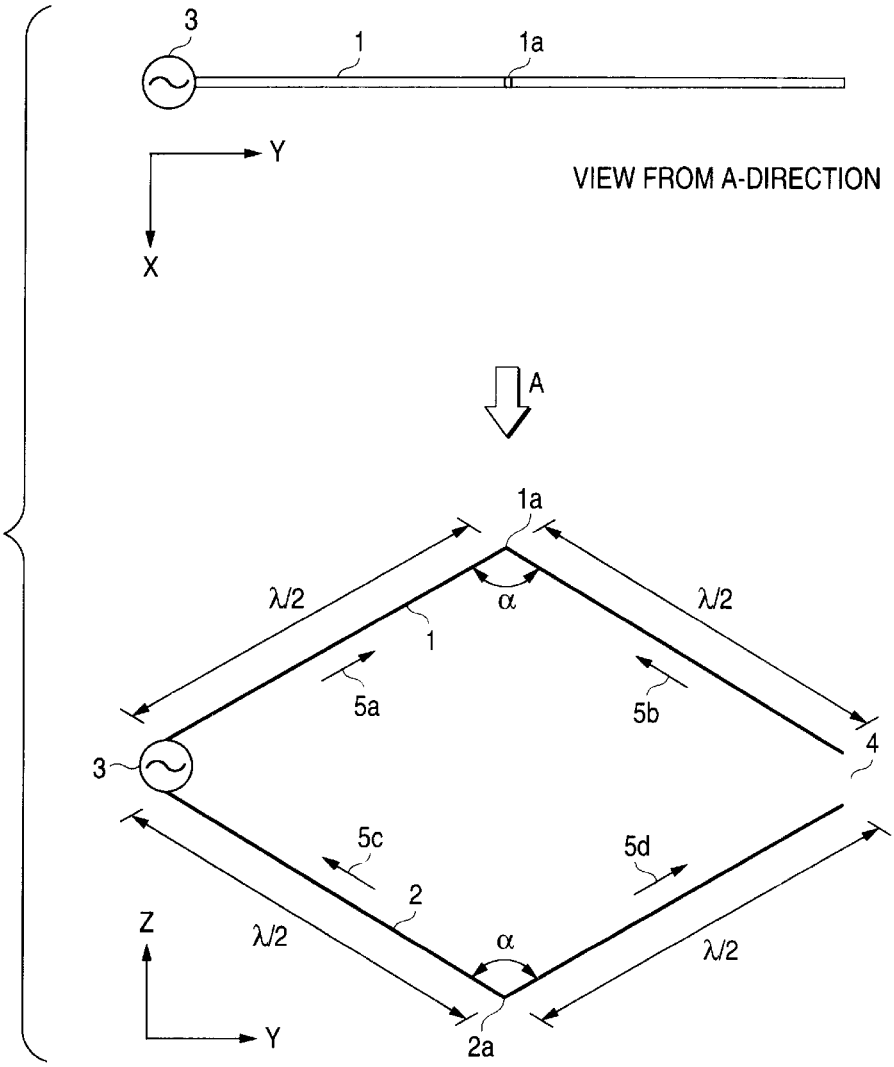
FIG. 1 is a view showing the configuration of an antenna device according to a first embodiment of the present invention.

An antenna device according to one embodiment comprises a first one-wavelength antenna element bent at an angle α in the center of the first antenna element, and a second one-wavelength antenna element bent at an angle α in the center of the second antenna element, wherein the first and second antenna elements are arranged in diamond-wise opposition to each other, wherein a feeding portion is disposed at one-ends of the first and second antenna elements, wherein the other-ends of the first and second antenna elements are opened, and wherein the angle α is selected to be an optimal angle. Hence, optimal radiation directivity can be obtained with a simple planar configuration. Hence, there is an effect in which an antenna device having a high gain can be obtained.

An antenna device according to another embodiment is configured so that a plurality of other first and second antenna elements are connected to forward ends of the first-mentioned first and second antenna elements. Hence, optimal radiation directivity improved in gain in the direction of main radiation can be obtained with a simple planar configuration. Hence, there is an effect in which an antenna device having a high gain can be obtained.

An antenna device according to still another embodiment is configured so that the angle α of bending in the center of each of the first and second antenna elements is selected to be an angle at which optimal radiation directivity can be obtained. Hence, optimal radiation directivity can be obtained with a simple planar configuration. Hence, there is an effect in which an antenna device having a high gain can be obtained.

An antenna device according to still another embodiment is configured so that a plurality of antenna devices defined in an earlier embodiment are connected in parallel with each other at the feeding portion. Hence, there is an effect in which an antenna device having a higher gain can be obtained with a simple planar configuration.

An antenna device according to still another embodiment is configured so that the angle α of bending in the center of each of the first and second antenna elements is selected to be an angle at which optimal radiation directivity can be obtained. Also in the case where a plurality of antenna devices are connected in parallel with each other at a feeding point, optimal radiation directivity can be obtained with a small-size and simple planar configuration. Hence, there is an effect in which an antenna device having a high gain can be obtained.

An antenna device according to still another embodiment is configured so that the first and second antenna elements are formed by a print pattern formed on a dielectric substrate. Also in the case where antenna elements are formed by a print pattern, desired radiation directivity can be obtained with a small-size and simple planar configuration. Hence, there is an effect in which an antenna device having a high gain can be obtained.

An antenna device according to still another embodiment is configured so that the plurality of other first and second antenna elements are connected to the first-mentioned first and second antenna elements respectively through transmission lines each having a fixed electrical length. Hence, the total length of the antenna can be elongated to a desired value in the Y-plane direction, so that desired radiation directivity can be obtained. Hence, there is an effect in which an antenna device having a high gain can be obtained.

An antenna device according to still another embodiment is configured so that two pairs of antenna devices defined in earlier embodiments are arranged in such a manner that the directions of main polarization crossing perpendicularly to each other and the two pairs of antenna devices are fed with phase differences of 90 degrees from each other. Hence, desired radiation directivity can be obtained with a simple planar configuration. Hence, there is an effect in which an antenna device to achieve a circular polarization antenna having a high gain can be obtained.

An antenna device according to still another embodiment is configured so that the antenna device defined in an earlier embodiment is formed by print patterns disposed on opposite surfaces of a dielectric substrate. Also in the case where two pairs of antenna devices are formed by print patterns with the directions of main polarization crossing perpendicularly to each other, desired radiation directivity can be obtained with a small-size and simple planar configuration. Hence, there is an effect in which an antenna device to achieve a circular polarization antenna having a high gain can be obtained.

An antenna device according to still another embodiment is configured so that the antenna devices defined in an earlier embodiment are arranged in such a manner that the directions of main polarization cross perpendicularly to each other, and the plurality of antenna devices are fed with phase differences of 90 degrees from each other. Hence, desired radiation directivity can be obtained with a simple planar configuration. Hence, there is an effect in which an antenna device to achieve a circular polarization antenna having a high gain can be obtained.

An antenna device according to still another embodiment is configured so that a reflection plate is provided in proximity to the antenna elements. Hence, desired radiation directivity can be obtained with a simple planar configuration. Hence, there is an effect in which an antenna device having a higher gain can be obtained.

An antenna device according to still another embodiment is configured so that a plurality of passive elements are provided in proximity to the antenna elements. Hence, desired radiation directivity can be obtained with a simple planar configuration. Hence, there is an effect in which an antenna device having a high gain can be obtained.

An antenna device according to still another embodiment is configured so that antenna devices defined in earlier embodiments are arranged as a radiator and a reflector, and a plurality of wave directors which are similar in shape to the antenna devices are arranged in the directions of main radiation. Hence, desired radiation directivity can be obtained with a simple configuration. Hence, there is an effect in which an antenna device having a higher gain can be obtained.

An antenna device according to still another embodiment is configured so that antenna devices defined in earlier embodiments are arranged in such a manner that the directions of main polarization are made identical with one another while the directions of main radiation are made different by 90 degrees from one another, and the plurality of antennas are fed with phase differences of 90 degrees from one another. Hence, desired radiation directivity can be obtained with a simple configuration. Hence, there is an effect in which an antenna device having a high gain can be obtained.

An antenna device according to still another embodiment is configured so that two pairs of antenna devices defined in earlier embodiments are arranged in such a manner that the directions of main polarization are made identical with each other while the directions of main radiation are made different from each other. Hence, desired radiation directivity can be obtained with a simple configuration. Hence, there is an effect in which an antenna device having a high gain can be obtained.

An antenna device according to still another embodiment is configured so that a plurality of antenna devices defined in earlier embodiments are arranged in such a manner that the directions of main polarization are made identical with each other while the directions of main radiation are made different from each other, and opposite antenna elements of at least one antenna device among the plurality of antenna devices are partially electronically connected/disconnected to/from each other. Hence, radiation directivity can be changed variously with a simple configuration so as to obtain a desired radiation direction. Hence, there is an effect in which a changeable directional antenna device having a high gain can be obtained.

An antenna device according to still another embodiment is configured so that a quarter-wavelength shorting stub is connected to a feeding point so that feeding is performed at a position where impedance of the shorting stub is optimized. Hence, good impedance matching can be obtained by a small-size matching circuit with a simple configuration. Hence, there is an effect in which an antenna device having a high gain can be obtained.

An antenna device according to still another embodiment comprises a first one-wavelength slot element provided in a conductor plate so as to be bent at an angle $\alpha$ in the center of the first slot element, and a second one-wavelength slot element provided in the conductor plate so as to be bent at an angle $\alpha$ in the center of the second slot element, wherein the first and second slot elements are arranged in diamond-wise opposition to each other, and wherein a feeding portion is disposed in one-ends of the first and second slot elements. Hence, desired radiation directivity can be obtained with a simple planar configuration. Hence, there is an effect in which a slot antenna having a high gain can be achieved.

An antenna device according to still another embodiment is configured so that the angle $\alpha$ is selected to be an angle at which optimal radiation directivity can be obtained. Hence, optimal radiation directivity can be obtained with a simple planar configuration. Hence, there is an effect in which a slot antenna having a high gain can be achieved.

An antenna device according to still another embodiment is configured so that a plurality of other first and second slot elements are connected to forward ends of the first-mentioned first and second slot elements. Hence, there is an effect in which a slot antenna having a high gain further improved in gain in the direction of main radiation can be achieved with a simple planar configuration.

An antenna device according to still another embodiment is configured so that the angle $\alpha$ is selected to be an angle at which optimal radiation directivity can be obtained. Hence, optimal radiation directivity can be obtained with a simple planar configuration. Hence, there is an effect in which a slot antenna having a high gain can be achieved.

An antenna device according to still another embodiment is configured so that a plurality of antenna devices defined in an earlier embodiment are connected in parallel with one another at a feeding portion. Hence, there is an effect in which a slot antenna having a higher gain can be achieved with a simple planar configuration.

An antenna device according to still another embodiment is configured so that the angle $\alpha$ is selected to be an angle at which optimal radiation directivity can be obtained. Hence, optimal radiation directivity can be obtained with a simple planar configuration. Hence, there is an effect in which a slot antenna having a high gain can be achieved.

An antenna device according to still another embodiment is configured so that the conductor plate and the slot elements are constituted by a print pattern formed on a dielectric substrate. Hence, optimal radiation directivity can be obtained with a small-size and simple planar configuration. Hence, there is an effect in which a slot antenna having a high gain can be achieved.

An antenna device according to still another embodiment is configured so that a reflection plate is provided in proximity to the conductor plate and the slot elements. Hence, desired radiation directivity can be obtained with a simple configuration. Hence, there is an effect in which a slot antenna having a higher gain can be achieved.

An antenna device according to still another embodiment is configured so that a plurality of passive elements are provided in proximity to the antenna elements. Hence, desired radiation directivity can be obtained with a simple configuration. Hence, there is an effect in which a slot antenna having a high gain can be achieved.

A radio apparatus according to still another embodiment is configured so that an antenna device defined in earlier embodiments is built in the radio apparatus. Hence, desired optimal radiation directivity can be obtained. Hence, there is an effect in which an antenna having a high gain can be built in a radio apparatus with a small-size and simple configuration.

An antenna device according to still another embodiment is configured so that a plurality of antenna devices defined in earlier embodiments are arranged. Hence, desired radiation directivity can be obtained with a small-size and simple configuration. Hence, there is an effect in which a diversity or sector antenna having a high gain can be achieved.

An antenna device according to still another embodiment is configured so that a reflection plate is provided so as to be used in common to the plurality of antenna devices. Hence, desired radiation directivity can be obtained with a small-size and simple configuration. Hence, there is an effect in which a diversity or sector antenna having a high gain can be achieved.

A radio base station according to still another embodiment is configured so that the radio base station is provided with an antenna device defined in an earlier embodiment. Hence, desired radiation directivity can be obtained with a small-size and simple configuration. Hence, there is an effect in which a diversity or sector antenna having a high gain can be used.

A directional gain control method according to still another embodiment is configured so that first and second antenna elements constituting an antenna device are arranged in diamond-wise opposition to each other, the first and second antenna elements having one-ends fed and the other-ends opened, each of the first and second antenna elements is bent at an angle α in a center thereof, and the angle α is selected to be an angle at which optimal radiation directivity can be obtained. Hence, desired optimal radiation directivity can be obtained with a simple planar configuration. Hence, there is an effect in which a method of controlling the directional gain of an antenna having a high gain can be obtained.

Embodiments of the present invention will be described below in detail with reference to the accompanying drawings FIGS. 1 through 23.

First Embodiment

Figure 2:
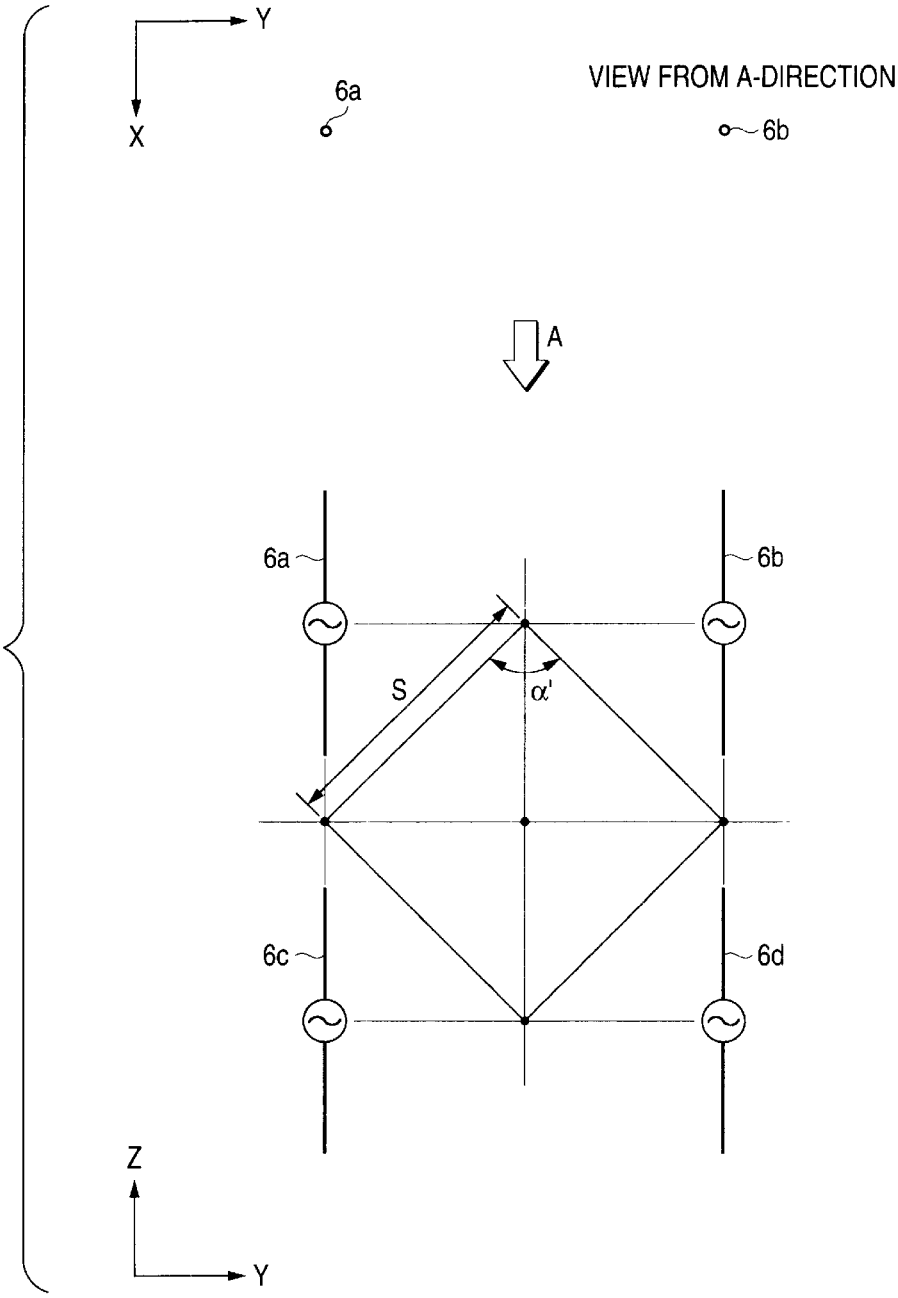
FIG. 2 is a typical view for explaining the operation of the antenna device shown in FIG. 1.
Figure 3:
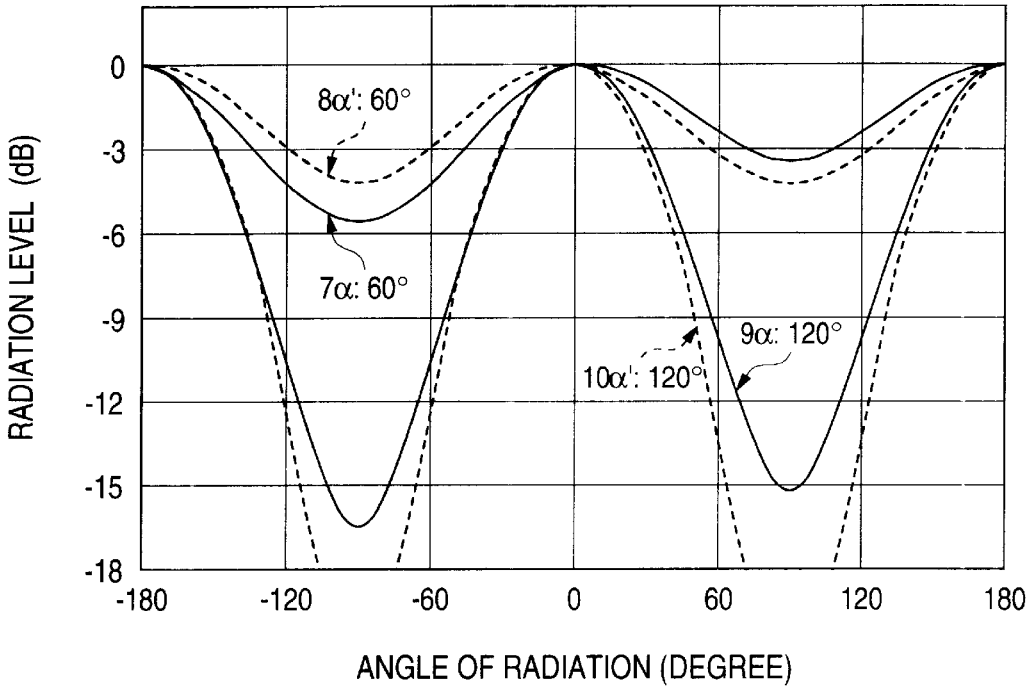
FIG. 3 is a graph showing the radiation pattern in a horizontal plane of the antenna device shown in FIG. 1.
Figure 4:
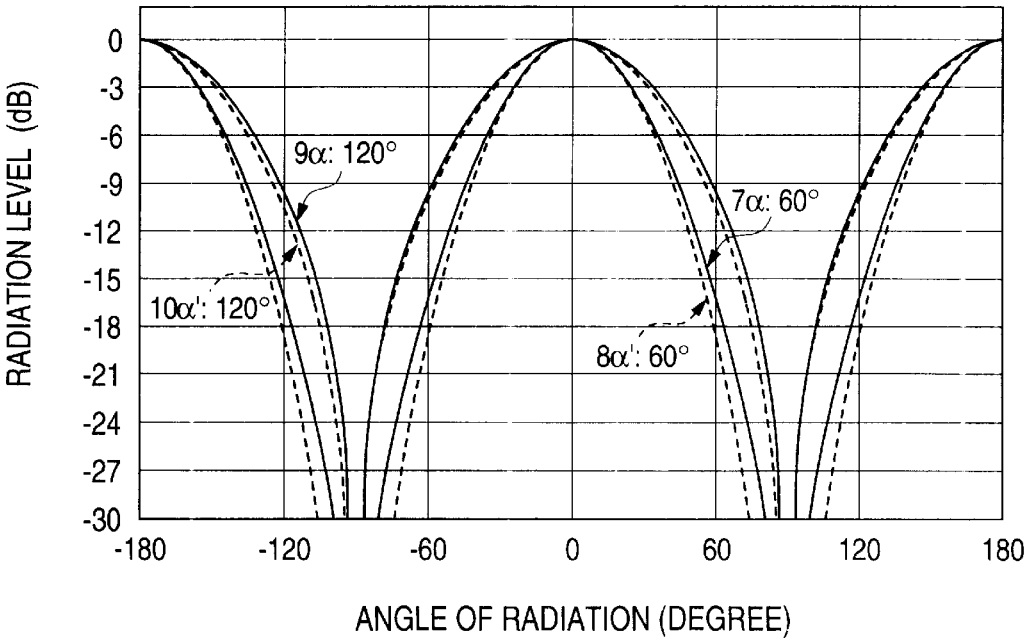
FIG. 4 is a graph showing the radiation pattern in a vertical plane of the antenna device shown in FIG. 1.

First, an antenna device according to a first embodiment of the present invention will be described in detail with reference to FIGS. 1 through 4. FIG. 1 is a view showing the configuration of the antenna device according to the first embodiment of the present invention. FIG. 2 is a typical view for explaining the operation of the antenna device shown in FIG. 1. FIG. 3 is a graph showing the radiation pattern in a horizontal plane of the antenna device shown in FIG. 1. FIG. 4 is a graph showing the radiation pattern in a vertical plane of the antenna device shown in FIG. 1.

Referring to FIG. 1, the configuration of the antenna device according to the first embodiment of the present invention will be described below. In FIG. 1, the reference numeral 1 designates a first antenna element; 2, a second antenna element; 3, a feeding portion; 4, an opening portion; and 1*a* and 2*a*, bent portions.

Next, the configuration of the antenna device according to this embodiment will be described in more detail. Each of the first and second antenna elements 1 and 2 is constituted by a conductor wire with a length of one wavelength. The first and second antenna elements 1 and 2 are bent at an angle α in the bent portions 1*a* and 2*a* respectively. The first and second antenna elements 1 and 2 are arranged in diamond-wise opposition to each other as shown in FIG. 1. Each side of the diamond shape has a half wavelength (λ/2). The feeding portion 3 is provided at one-ends of the first and second antenna elements 1 and 2 respectively. The other-ends of the first and second antenna elements 1 and 2 are electrically opened as represented by the opening portion 4. When, for example, the operating frequency of the antenna device is set to 1900 MHz, the length of each of the first and second antenna elements 1 and 2 is about 158 mm and each side of the diamond shape is 79 mm. The angle α is selected to be approximately in a range of from 30 to 150 degrees.

Referring to FIGS. 2 through 4, the operation of the antenna device according to this embodiment will be described below. In the antenna device configured as shown in FIG. 1, when the feeding portion 3 is excited by a high-frequency signal, currents distributed in the first and second antenna elements 1 and 2 are as represented by the arrows 5*a* to 5*d* because each side of the diamond shape has a half wavelength (λ/2). As a result, the antenna device operates so that respective horizontal components (Y-axis components) of the currents 5*a* to 5*d* cancel one another whereas respective vertical components (Z-axis components) of the currents 5*a* to 5*d* intensify one another. Thus, vertically (Z-axis) polarized electric wave is radiated. The radiation of the vertically (Z-axis) polarized electric wave is maximized in the X direction and in the −X direction in FIG. 1. In this case, a directional gain of about 6 dB is obtained.

This operation is equivalent to that of an array antenna constituted by four half-wavelength dipole antennas arranged as shown in FIG. 2. In FIG. 2, the reference numerals 6a to 6*d* designate vertical polarization half-wavelength dipole antennas. The dipole antennas 6*a* to 6*d* are arranged with vertical and horizontal arrangement intervals determined on the basis of the angle α' and distance S between the dipole antennas 6*a* to 6*d*. When the dipole antennas 6*a* to 6*d* are excited by in-phase and equiamplitude signals respectively, intensive radiation synthesized in the X-axis direction is generated. The pattern of the radiation is determined on the basis of arrangement coefficients owing to the vertical and horizontal arrangement intervals.

In FIG. 2, when the distance S is fixed to about 0.32λ (0.32 times as large as the wavelength), the change of the radiation pattern in the case where the angle α of each of the bent portions 1*a* and 2*a* of the first and second antenna elements 1 and 2 in the antenna device according to the first embodiment as shown in FIG. 1 is changed is approximately equal to the change of the radiation pattern in the case where the angle α' between the dipole antennas 6*a* to 6*d* in the array antenna shown in FIG. 2 is changed. This state will be described below with reference to FIGS. 3 and 4.

FIG. 3 is a graph showing the radiation pattern of vertically polarized wave in a horizontal plane (XY plane) in each of the antenna devices shown in FIGS. 1 and 2. The horizontal axis indicates an angle (degrees) of radiation and the angle of 0 degree indicates the X direction. The vertical axis indicates a radiation level relative value normalized by a level in a maximum radiation direction. In FIG. 3, the reference numeral 7 designates a radiation pattern in the case where the angle α of each of the bent portions 1*a* and 2*a* of the antenna device in FIG. 1 is equal to 60 degrees. The reference numeral 8 designates a radiation pattern in the case where the angle α' between the dipole antennas in FIG. 2 is equal to 60 degrees. The reference numeral 9 designates a radiation pattern in the case where the angle α of each of the bent portions 1*a* and 2*a* of the antenna device in FIG. 1 is equal to 120 degrees. The reference numeral 10 designates a radiation pattern in the case where the angle α' between the dipole antennas in FIG. 2 is equal to 120 degrees.

Next, FIG. 4 is a graph showing the radiation pattern of vertically polarized wave in a vertical plane (XZ plane) in each of the antenna devices shown in FIGS. 1 and 2. In FIG. 4, the reference numerals 7 to 10 designate radiation patterns similar to those in FIG. 3. Here, by changing the angle α of each of the bent portions 1*a* and 2*a* in the antenna device according to the first embodiment as shown in FIG. 1, the radiation patterns in the horizontal plane and in the vertical plane can be changed greatly. When, for example, the angle α is changed to increase from 60 degrees to 120 degrees, the half-value width (the width of the radiation angle to obtain −3 dB) of the radiation pattern in the horizontal plane decreases from 118 degrees to 64 degrees, while the half-value width of the radiation pattern in the vertical plane increases from 50 degrees to 68 degrees. The array antenna shown in FIG. 2 has this tendency similarly. When, for example, the angle α of each of the bent portions 1*a* and 2*a* is changed to increase from 30 degrees to 150 degrees, the half-value width of the radiation pattern in the horizontal plane changes from approximately non-directivity to 47 degrees and the half-value width of the radiation pattern in the vertical plane increases from 50 degrees to 80 degrees.

Although this embodiment has shown the case where the direction of main polarization is vertical (Z), the same operation as described above can be carried out by a horizontal polarization antenna in the case where the antenna device in FIG. 1 is arranged to be rotated by 90 degrees so that the direction of main polarization is changed to horizontal (Y).

As described above, in the antenna device according to the first embodiment, radiation patterns in the horizontal plane and in the vertical plane can be controlled by changing the angle α. Hence, an antenna having desired directivity and having a high gain can be achieved with a simple planar configuration.

Second Embodiment

Figure 5:
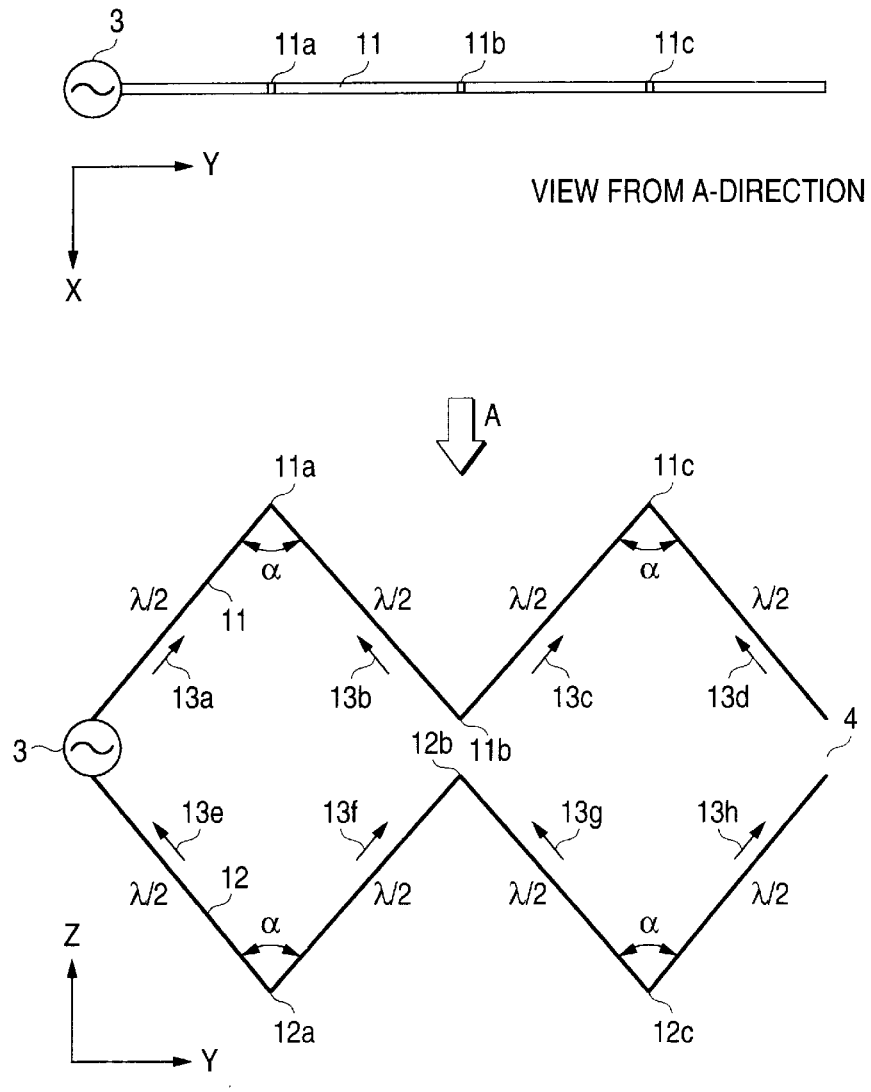
FIGS. 5 to 23 are views showing the configurations of antenna devices according to second to twentieth embodiments of the present invention respectively.

Referring to FIG. 5, an antenna device according to a second embodiment of the present invention will be described below. FIG. 5 is a view showing the configuration of the antenna device according to the second embodiment of the present invention. In FIG. 5, the reference numeral 3 designates a feeding portion; 4, an opening portion; 11, a first antenna element; 12, a second antenna element; and 11*a*, 11*b*, 11*c*, 12*a*, 12*b* and 12*c*, bent portions.

Further, the configuration of the antenna device according to this embodiment will be described in more detail. As shown in FIG. 5, the first and second antenna elements 11 and 12 are arranged so oppositely that two diamond-shaped antenna devices each constituted by first and second antenna elements 1 and 2 as shown in FIG. 1 are connected to each other. The length of each side of the diamond shape is equal to a half wavelength (λ/2). That is, each of the first and second antenna elements 11 and 12 is constituted by a conductive wire having a length equal to two wavelengths. The first and second antenna elements 11 and 12 are bent at an angle α in the bent portions 11*a* to 11*c* and 12*a* to 12*c* respectively. The feeding portion 3 is provided at one-ends of the first and second antenna elements 11 and 12 respectively. The opposite ends of the first and second antenna elements 11 and 12 are electrically opened as shown by the opening portion 4.

Referring to FIG. 5, the operation of the antenna device according to this embodiment will be described below. In the antenna device configured as described above, when the feeding portion 3 is excited by a high-frequency signal, currents distributed into respective sides of the first and second antenna elements 11 and 12 are as indicated by the arrows 13*a* to 13*h* because the length of each side of the diamond shape is equal to a half wavelength (λ/2). As a result, an operation is carried out so that horizontal components (Y-axis components) of the respective currents cancel one another while vertical components (Z-axis components) of the respective currents intensify one another. Hence, vertically (Z-axis) polarized electric wave is radiated. The radiation of electric wave is maximized in the X direction and in the −X direction in FIG. 5, so that a directional gain of about 9 dB is obtained.

This operation is approximately equivalent to the operation of an array antenna in which two antenna devices according to the first embodiment as shown in FIG. 1 are arranged in the Y direction. Hence, in the antenna device according to the second embodiment in FIG. 5, radiation patterns in the horizontal plane and in the vertical plane can be changed greatly by changing the angle α. When, for example, the angle α is changed to increase from 60 degrees to 120 degrees, the half-value width of the radiation pattern in the horizontal plane decreases from 50 degrees to 30 degrees while the half-value width of the radiation pattern in the vertical plane increases from 50 degrees to 68 degrees. Here, the half-value width of the radiation pattern in the horizontal plane is reduced to about a half compared with the antenna device according to the first embodiment as shown in FIG. 1.

Incidentally, in the case where a plurality of antenna elements of diamond-shapes are connected to form one antenna device like in this embodiment, if the bent portions 11*b* and 12*b* which form junction portions of the diamond shapes are cut off, the diamond shapes are separated from each other. Then, if the first antenna elements 11 cut off thus are connected to each other again through a transmission line having a fixed electrical length whereas the second antenna elements 12 cut off thus are also connected to each other through a transmission line having a fixed electrical length, the whole length of the antenna device can be controlled if it is desired.

As described above, in the antenna device according to this embodiment, radiation patterns in the horizontal plane and in the vertical plane can be controlled by changing the angle α. Hence, an antenna having desired directivity and having a high gain can be achieved with a simple planar configuration.

Third Embodiment

Figure 6:
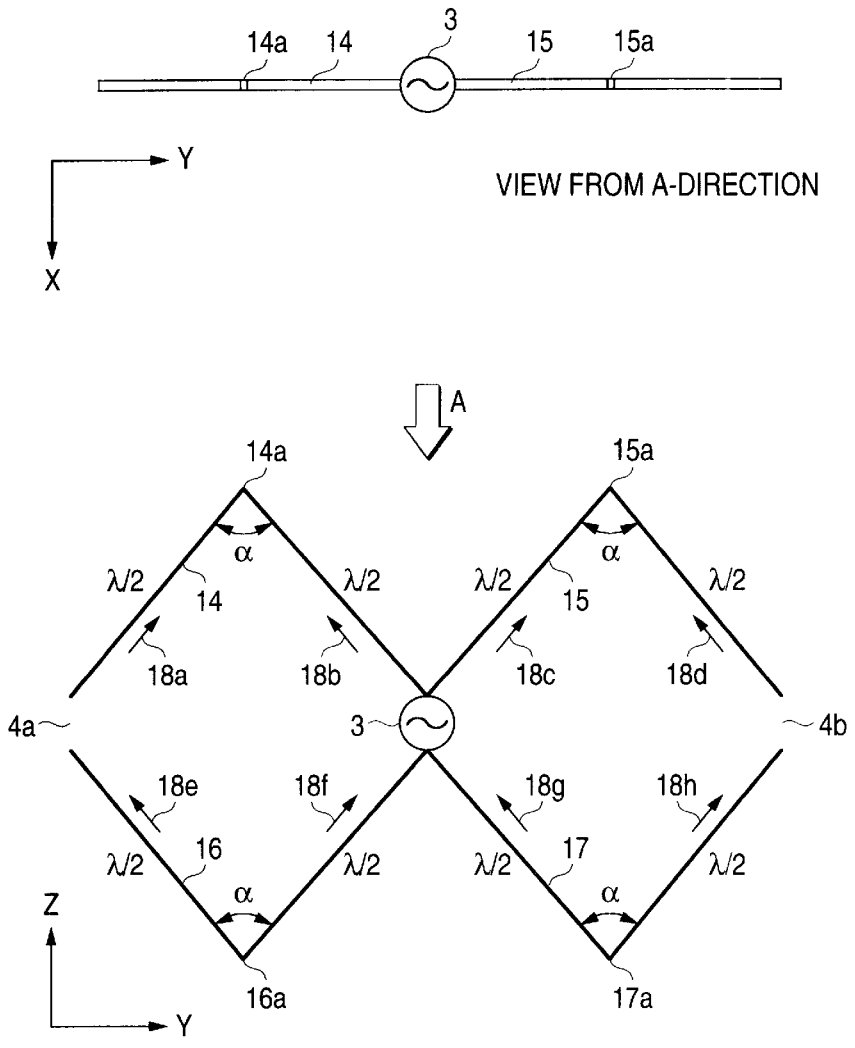

Referring to FIG. 6, an antenna device according to a third embodiment of the present invention will be described below. FIG. 6 is a view showing the configuration of the antenna device according to the third embodiment of the present invention. In FIG. 6, the reference numeral 3 designates a feeding portion; 4*a* and 4*b*, opening portions; 14 and 15, first antenna elements; 16 and 17, second antenna elements; and 14*a*, 15*a*, 16*a* and 17*a*, bent portions.

Further, the configuration of the antenna device according to this embodiment will be described in more detail. Each of the first and second antenna elements 14 to 17 is constituted by a conductive wire having a length equal to one wavelength. The first and second antenna elements 14 to 17 are bent at an angle α in the bent portions 14*a* to 17*a* respectively. The first antenna elements 14 and 15 and the second antenna elements 16 and 17 are connected as shown in FIG. 6. The feeding portion 3 is provided in junction portions between the first antenna elements 14 and 15 and between the second antenna elements 16 and 17. Other ends are electrically opened as represented by the opening portions 4*a* and 4*b*.

Referring to FIG. 6, the operation of the antenna device according to this embodiment will be described below. In the antenna device configured as described above, when the feeding portion 3 is excited by a high-frequency signal, currents distributed into respective sides of the first and second antenna elements 14 to 17 flow as indicated by the arrows 18*a* to 18*h* because the length of each side of the diamond shape is equal to a half wavelength (λ/2). As a result, an operation is carried out so that horizontal components (Y-axis components) of the respective currents cancel one another while vertical components (Z-axis components) of the respective currents intensify one another. Hence, vertically (Z-axis) polarized electric wave is radiated. The radiation of vertically (Z-axis) polarized electric wave is maximized in the X direction and in the −X direction in FIG. 6, so that a directional gain of about 9 dB is obtained.

This operation is approximately equivalent to the operation of an array antenna in which two antenna devices according to the first embodiment as shown in FIG. 1 are arranged so as to be fed in parallel in the Y direction. Hence, in the antenna device according to the third embodiment in FIG. 6, the change of radiation patterns in the case where the angle α is changed is approximately equivalent to that in the antenna device according to the second element in FIG. 5. Further, feeding-point impedance is reduced to a value not higher than a half of that of the antenna device according to the first embodiment as shown in FIG. 1 to be thereby favorable for matching the impedance with the transmission line.

Although this embodiment has shown the case where antenna devices as shown in FIG. 1 are fed in parallel, the same effect as described above can be obtained also in the case where antenna devices as shown in FIG. 5 are fed in parallel.

As described above, in the antenna device according to the third embodiment, the feeding-point impedance can be reduced and the radiation patterns in the horizontal plane and in the vertical plane can be controlled by changing the angle α. Hence, an antenna having desired directivity and having a high gain can be achieved with a simple planar configuration.

Fourth Embodiment

Figure 7:
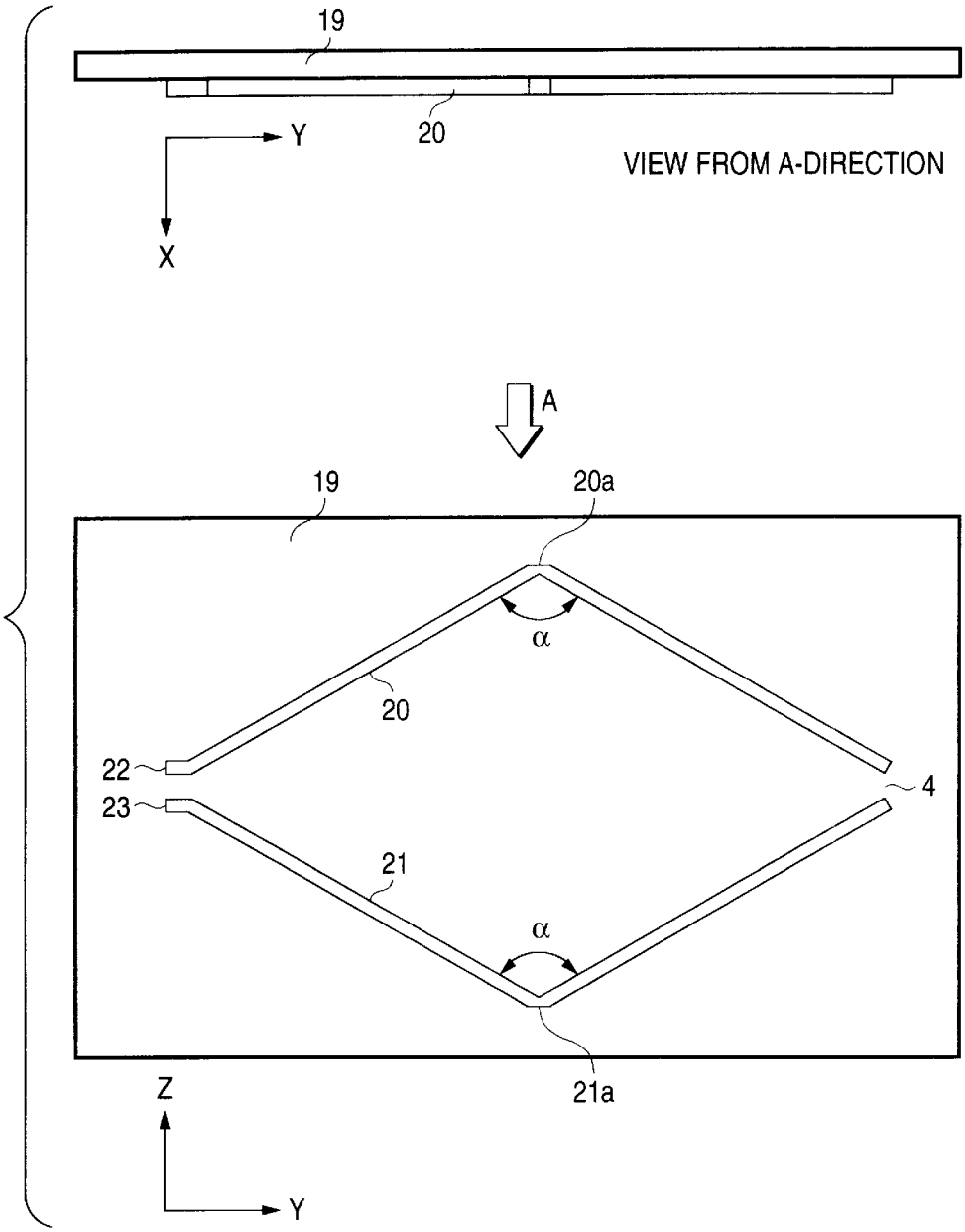

Referring to FIG. 7, an antenna device according to a fourth embodiment of the present invention will be described below. FIG. 7 is a view showing the configuration of the antenna device according to the fourth embodiment of the present invention. In FIG. 7, the reference numeral 4 designates an opening portion; 19, a dielectric substrate; 20, a first antenna pattern as a first antenna element; 21, a second antenna pattern as a second antenna element; 22 and 23, feeding terminals; and 20*a* and 21*a*, bent portions.

Further, the configuration of the antenna device according to this embodiment will be described in more detail. Each of the first and second antenna patterns 20 and 21 is constituted by a print pattern formed on the dielectric substrate 19. The first and second antenna patterns 20 and 21 are bent at an angle α in the bent portions 20*a* and 21*a* respectively. The length of each of the first and second antenna patterns 20 and 21 is selected to be equal to one wavelength on the dielectric substrate. When, for example, the effective relative dielectric constant of the dielectric substrate is 2, the length of each of the first and second antenna patterns 20 and 21 is about 80 mm for the operating frequency of 1900 MHz because the wavelength on the dielectric substrate is reduced to about a half of the wavelength in a free space.

Referring to FIG. 7, the operation of the antenna device according to this embodiment will be described below. In the antenna device configured as described above, when the feeding terminals 22 and 23 are excited by a high-frequency signal, the antenna device operates in the same manner as in the antenna device according to the first embodiment in FIG. 1. Hence, more detailed description will be omitted.

As described above, in the antenna device according to the fourth embodiment, an antenna having desired directivity and having a high gain can be achieved with a small-size and simple planar configuration by a print pattern on a dielectric substrate.

Fifth Embodiment

Figure 8:
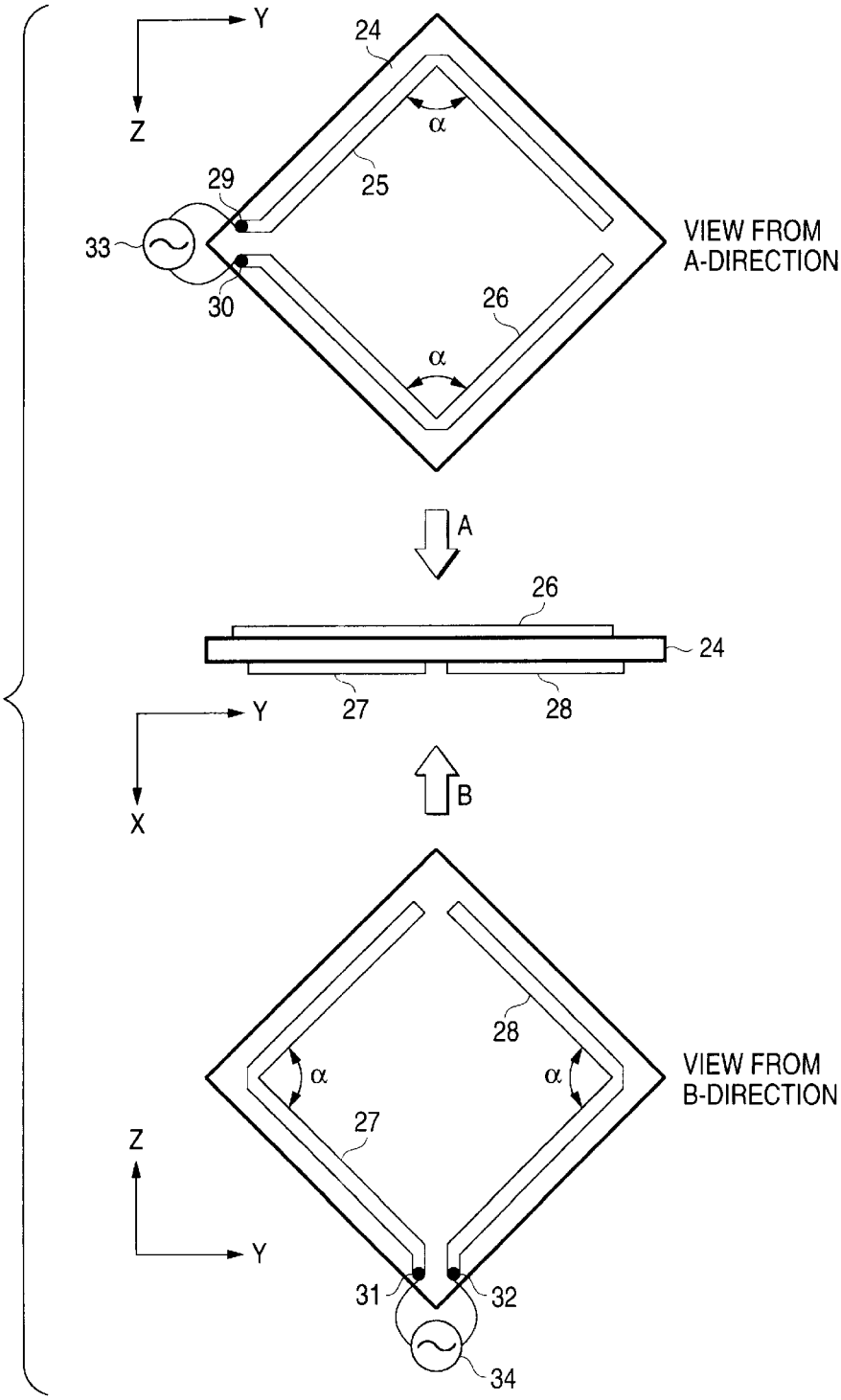

Referring to FIG. 8, an antenna device according to a fifth embodiment of the present invention will be described below. FIG. 8 is a view showing the configuration of the antenna device according to the fifth embodiment of the present invention. In FIG. 8, the reference numeral 24 designates a dielectric substrate; 25, 26, 27 and 28, antenna patterns as antenna elements; 29, 30, 31 and 31, feeding terminals; and 33 and 34, high-frequency signal sources.

Further, the configuration of the antenna device according to this embodiment will be described in more detail. The antenna patterns 25 and 26 are constituted by a print pattern formed on one surface of the double-side copper-clad dielectric substrate 24, while the antenna patterns 27 and 28 are constituted by a print pattern formed on the other surface of the double-side copper-clad dielectric substrate 24. The length of each of the antenna patterns 25, 26, 27 and 28 is selected to be equal to one wavelength on the dielectric substrate. A combination of the antenna patterns 25 and 26 and the feeding portions 29 and 30 and a combination of the antenna patterns 27 and 28 and the feeding portions 31 and 32 serve as independent antennas. Each of the antennas operates in the same manner as in the antenna device according to the fourth embodiment in FIG. 7.

Referring to FIG. 8, the operation of the antenna device according to this embodiment will be described below. In the antenna device configured as described above, when excitation is given from the high-frequency signal sources 33 and 34, the antenna patterns 25 and 26 radiate vertically (Z-direction) polarized wave whereas the antenna patterns 27 and 28 radiate horizontally (Y-direction) polarized wave. Hence, when the phases of the high-frequency signal sources 33 and 34 are selected to be made different by 90 degrees from each other, circularly polarized electric wave is radiated in the X direction and in the −X direction, so that a directional gain of about 6 dB is obtained. Further, left-handed circularly polarized wave or right-handed circularly polarized wave is radiated either in the X direction or in the −X direction. The rotational direction is determined on the basis of the lag-lead relation between the phases of the high-frequency signal sources 33 and 34.

Incidentally, although this embodiment has shown the case where the antenna device is formed on the dielectric substrate, the same effect as described above can be obtained also in the case where two pairs of antenna devices as shown in FIG. 1 are arranged with directions of polarization crossing perpendicularly to each other.

As described above, in the antenna device according to the fifth embodiment, a circular polarization antenna having desired directivity and having a high gain can be achieved with a small-size and simple planar configuration by print patterns on a dielectric substrate.

Sixth Embodiment

Figure 9:
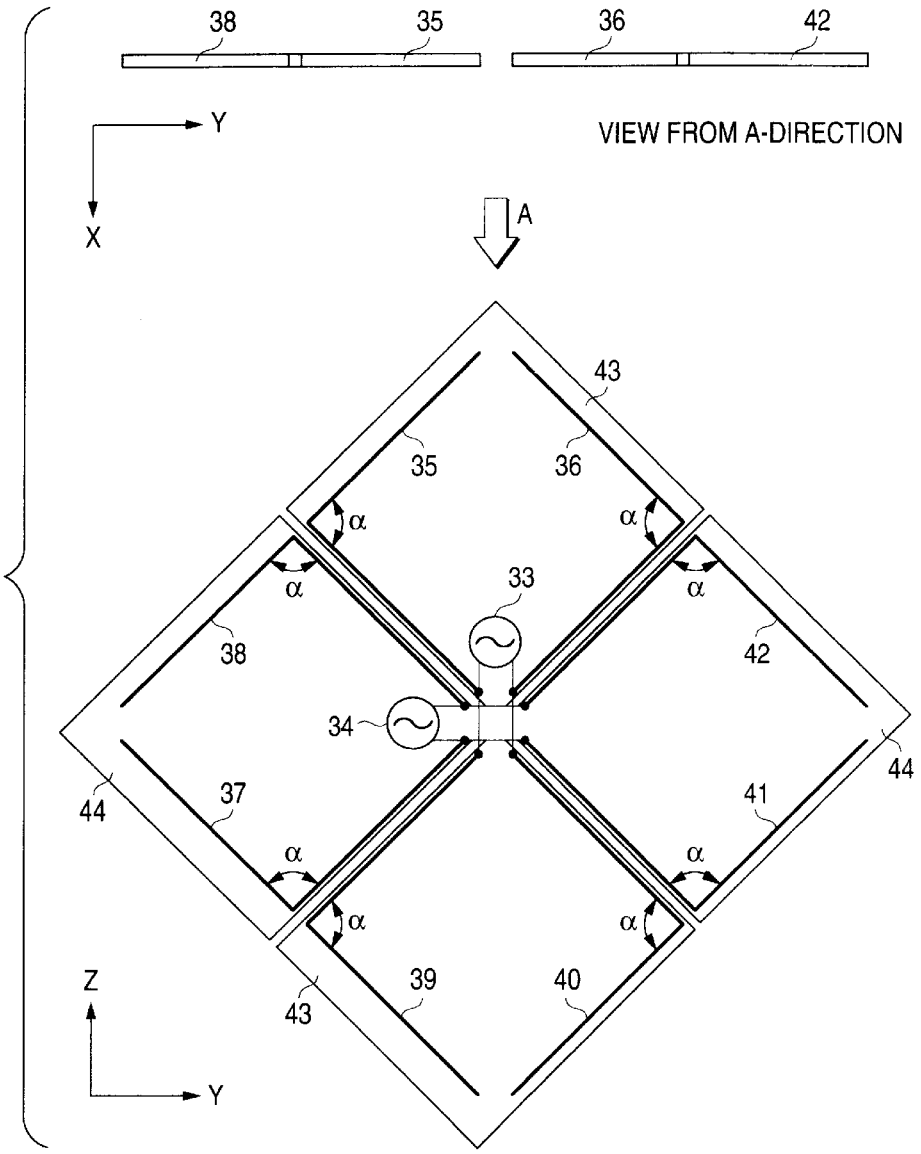

Referring to FIG. 9, an antenna device according to a sixth embodiment of the present invention will be described below. FIG. 9 is a view showing the configuration of the antenna device according to the sixth embodiment of the present invention. In FIG. 9, the reference numerals 33 and 34 designate high-frequency signal sources; 35, 36, 37, 38, 39, 40, 41 and 42, antenna elements; 43, a horizontal polarization antenna system; and 44, a vertical polarization antenna system.

Referring to FIG. 9, the operation of the antenna device according to this embodiment will be described below. The antenna elements 35, 36 and 39, 40 are excited by the high-frequency signal source 33, so that they serve as a horizontal polarization antenna system 43 which operates in the same manner as the antenna device according to the third embodiment in FIG. 6. The antenna elements 38, 39 and 41, 42 are excited by the high-frequency signal source 34, so that they serve as a vertical polarization antenna system 44 which operates in the same manner as the antenna device according to the third embodiment in FIG. 6.

The horizontal polarization antenna system 43 and the vertical polarization antenna system 44 are arranged so as to cross perpendicularly to each other in the YZ plane. Hence, when the phases of the high-frequency signal sources 33 and 34 are selected to be made different by 90 degrees from each other, circular lypolarized electric wave is radiated in the X direction and in the −X direction, so that a directional gain of about 8 dB is obtained. Further, left-handed circularly polarized wave or right-handed circularly polarized wave is radiated either in the X direction or in the −X direction. The rotational direction is determined on the basis of the lag-lead relation between the phases of the high-frequency signal sources 33 and 34.

As described above, in the antenna device according to the sixth embodiment, a circular polarization antenna having desired directivity and having a high gain can be achieved with a simple planar configuration.

Seventh Embodiment

Figure 10:
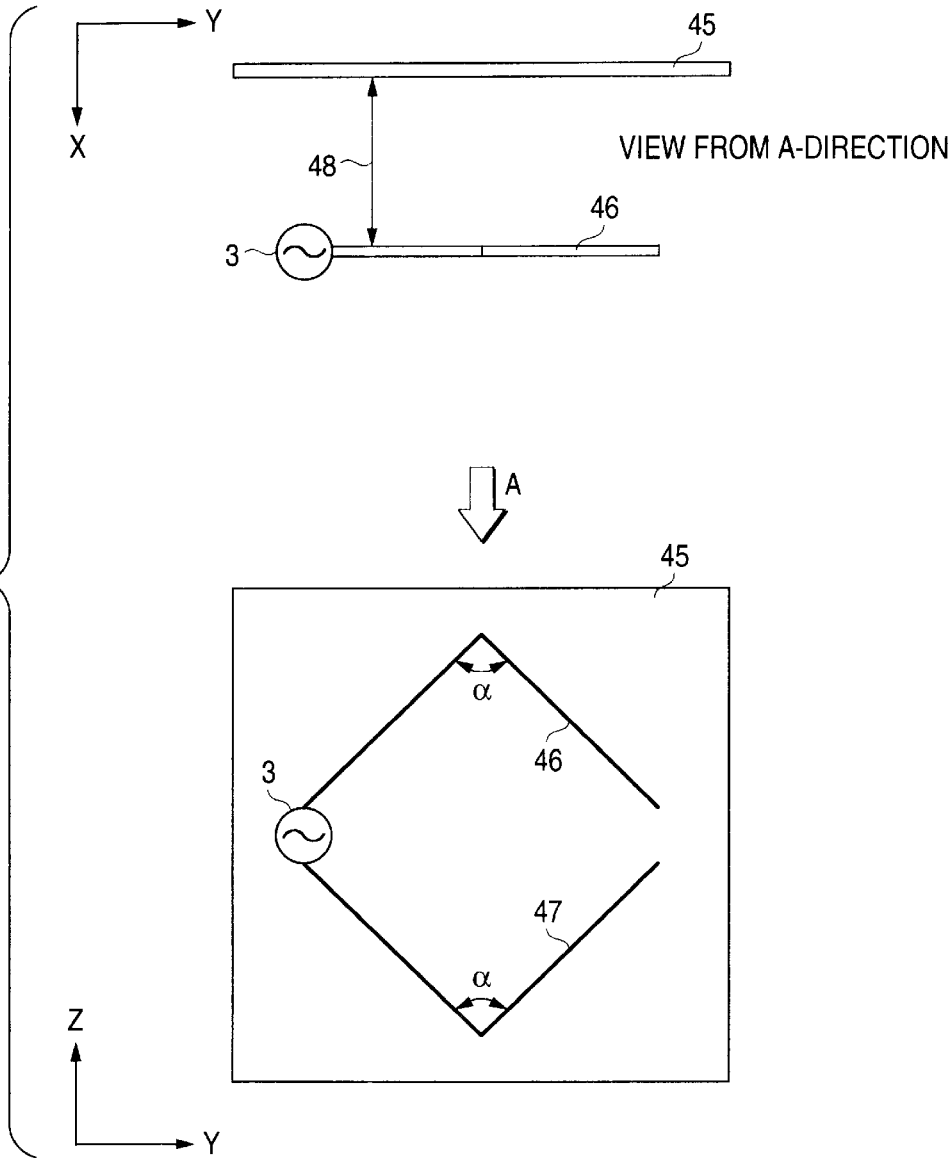

Referring to FIG. 10, an antenna device according to a seventh embodiment of the present invention will be described below. FIG. 10 is a view showing the configuration of the antenna device according to the seventh embodiment of the present invention. In FIG. 10, the reference numeral 3 designates a feeding portion; 45, a reflection plate; and 46 and 47, antenna elements.

Referring to FIG. 10, the operation of the antenna device according to this embodiment will be described below. The antenna elements 46 and 47 operate in the same manner as in the antenna device according to the first embodiment in FIG. 1, so that maximum radiation is generated in the X direction and in the −X direction. In this embodiment, however, the antenna elements 46 and 47 are arranged so as to be distanced from the reflection plate 45 by a distance indicated by the reference numeral 48. The wave radiated in the −X direction is reflected by the reflection plate 45, so that the reflected wave is radiated in the X direction. Hence, radiation patterns are concentrated into the X direction. When the distance 48 is selected to be about 0.3λ(0.3 times as large as the wavelength), a directional gain of about 9.5 dB can be obtained in the X direction.

Incidentally, also in this embodiment, radiation patterns in the horizontal plane and in the vertical plane can be controlled by changing the angle α in the bent portions.

As described above, in the antenna device according to the seventh embodiment, an antenna device having desired directivity and having a high gain can be achieved with a simple planar configuration.

Eighth Embodiment

Figure 11:
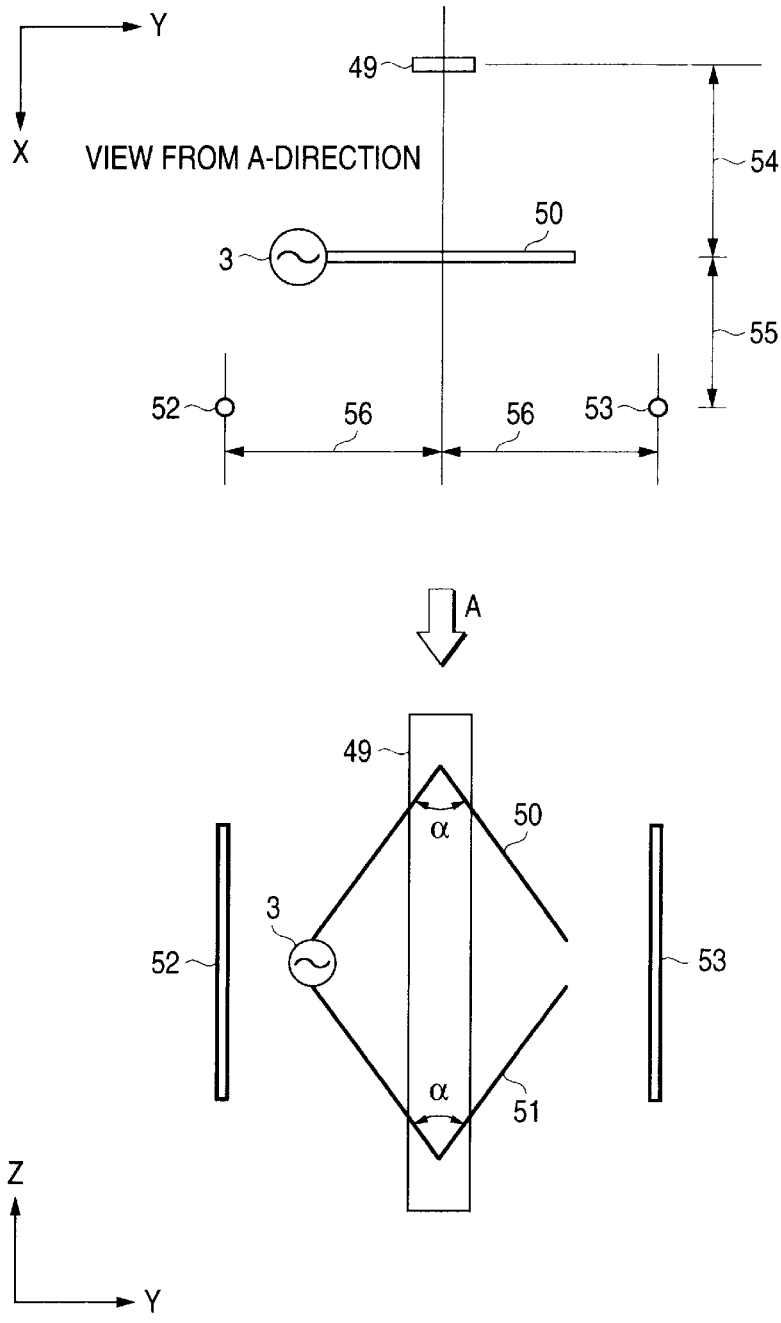

Referring to FIG. 11, an antenna device according to an eighth embodiment of the present invention will be described below. FIG. 11 is a view showing the configuration of the antenna device according to the eighth embodiment of the present invention. In FIG. 11, the reference numeral 3 designates a feeding portion; 49, a reflection plate; 50 and 51, antenna elements; and 52 and 53, passive elements.

Referring to FIG. 11, the detailed configuration and operation of the antenna device according to this embodiment will be described below. The antenna elements 50 and 51 operate in the same manner as in the antenna device according to the first embodiment in FIG. 1. Further, the antenna elements 50 and 51 are arranged so as to be separated by a distance 54 from the reflection plate 49. Each of the passive elements 52 and 53 is constituted by a conductive wire which is slightly shorter than a half wavelength. The passive elements 52 and 53 are arranged in positions which are separated by a distance 55 in the X direction from the antenna elements 52 and 53 and which are separated by a distance 56 in the Y and −Y directions from the center respectively. When each of the distances 54 and 55 is selected to be about 0.3λ (0.3 times as large as the wavelength) and the distance 56 is selected to be about 0.4λ (0.4 times as large as the wavelength), wide-angle directivity of 180 degrees as a half-value width can be obtained in the X direction, so that a directional gain of about 6.5 dB can be obtained.

As described above, in the antenna device according to the eighth embodiment, an antenna device having wide-angle directivity of 180 degrees as a half-value width and having a high gain can be achieved with a simple configuration.

Ninth Embodiment

Figure 12:
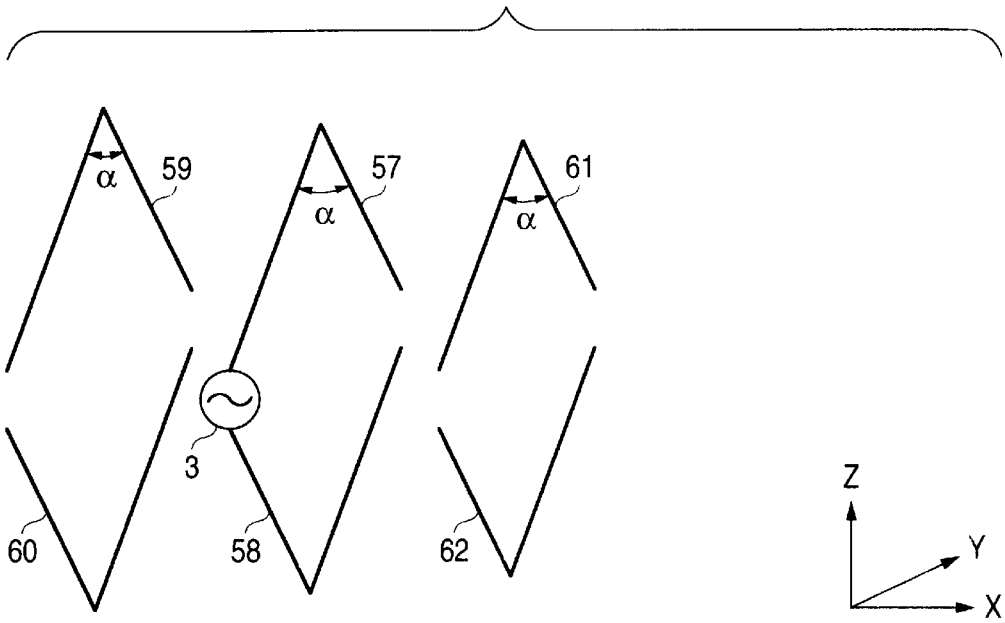

Referring to FIG. 12, an antenna device according to a ninth embodiment of the present invention will be described below. FIG. 12 is a view showing the configuration of the antenna device according to the ninth embodiment of the present invention. In FIG. 12, the reference numeral 3 designates a feeding portion; and 57, 58, 59, 60, 61 and 62, antenna elements.

Referring to FIG. 12, the operation of the antenna device according to this embodiment will be described below. The antenna elements 57 and 58 and the feeding portion 3 operate in the same manner as in the antenna device according to the first embodiment in FIG. 1, so that they serve as a radiator. Each of the antenna elements 59 and 60 is selected to have a length longer by about 4% than that of each of the antenna elements 57 and 58. The antenna elements 59 and 60 are arranged so as to be separated by about 0.2λ (0.2 times as large as the wavelength) in the −X direction from the antenna elements 57 and 58, so that they serve as a reflector. Further, each of the antenna elements 61 and 62 is selected to have a length shorter by about 8% than that of each of the antenna elements 57 and 58. The antenna elements 61 and 62 are arranged so as to be separated by about 0.2λ (0.2 times as large as the wavelength) in the X direction from the antenna elements 57 and 58, so that they serve as a wave director.

The antenna device configured as described above operates as a whole in the same manner as a Yagi antenna. Hence, radiation directivity is concentrated into the X direction, so that a directional gain of about 11 dB is obtained.

Although this embodiment has shown the case where a three-element Yagi antenna is formed, a higher gain can be obtained if a larger number of elements are arranged. When, for example, 5 elements are provided, a directional gain of about 12.5 dB can be obtained. Also in this embodiment, directivity in the vertical plane and in the horizontal plane can be changed by changing the angle α in the bent portions.

As described above, in the antenna device according to the ninth embodiment, a Yagi antenna having desired directivity and having a high gain can be achieved with a simple configuration.

Tenth Embodiment

Figure 13:
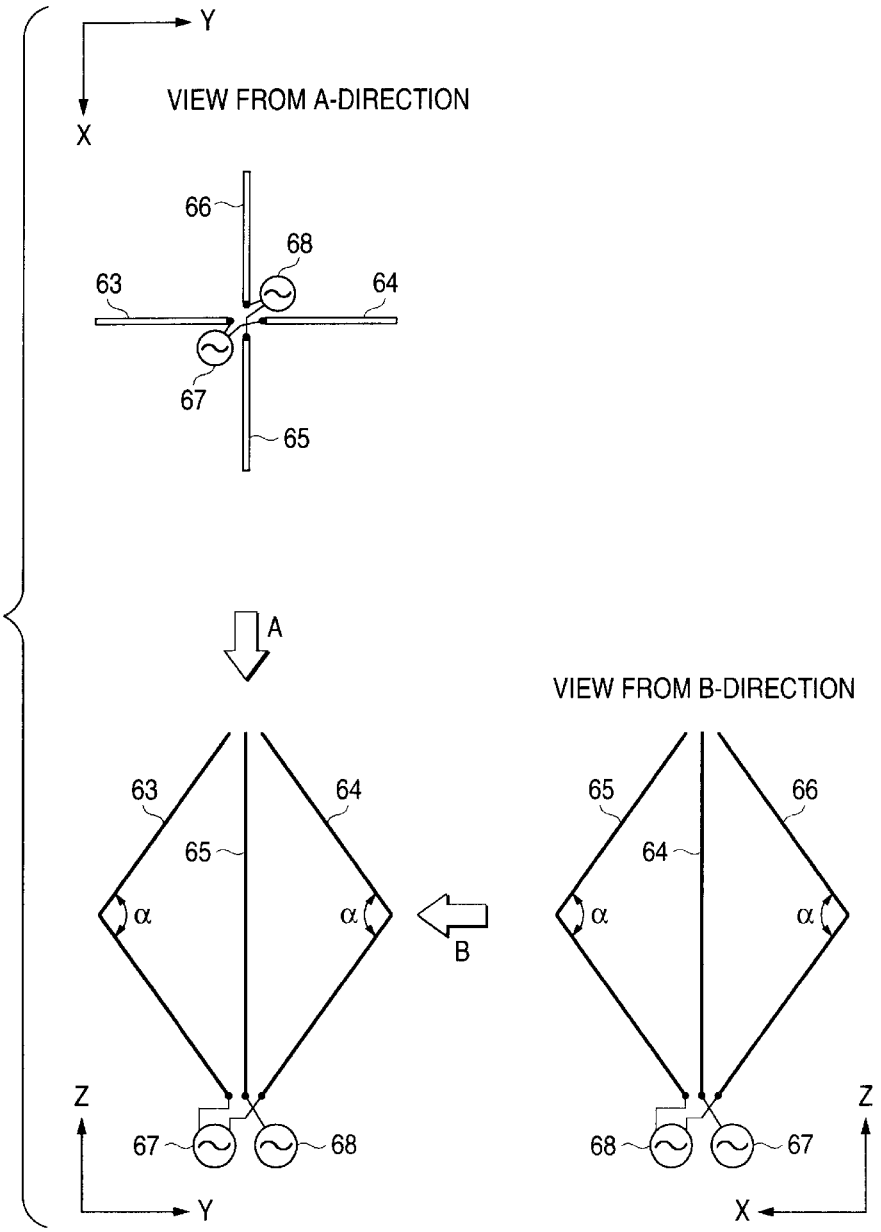

Referring to FIG. 13, an antenna device according to a tenth embodiment of the present invention will be described below. FIG. 13 is a view showing the configuration of the antenna device according to the tenth embodiment of the present invention. In FIG. 13, the reference numerals 63, 64, 65 and 66designate antenna elements; and 67 and 68, high-frequency signal sources.

Referring to FIG. 13, the detailed configuration and operation of the antenna device according to this embodiment will be described below. The antenna elements 63 and 64 and the feeding portion 67 operate in the same manner as in the antenna device according to the first embodiment in FIG. 1. The antenna elements 65 and 66 and the feeding portion 68 also operate in the same manner as in the antenna device according to the first embodiment in FIG. 1. The antenna elements 63, 64 and 65, 66 are arranged so that the direction of main polarization in the antenna elements 63 and 64 is identical with that in the antenna elements 65 and 66 in terms of horizontally polarized wave, whereas the directions of main radiation cross perpendicularly to each other.

When the antenna element 63 and 64 and the antenna element pair 65 and 66 are supplied with high-frequency signals 67 and 68 respectively so that the phases of the signals are made different by 90 degrees from each other, the antenna device exhibits non-directional radiation characteristic in the horizontal plane in terms of horizontally polarized wave, so that a gain of about 3.5 dB can be obtained.

Also in this embodiment, directivity in the vertical plane and in the horizontal plane can be changed by changing the angle $\alpha$ in the bent portions.

As described above, in the antenna device according to the tenth embodiment, a horizontal non-directional antenna having a high gain can be achieved with a simple configuration.

Eleventh Embodiment

Figure 14:
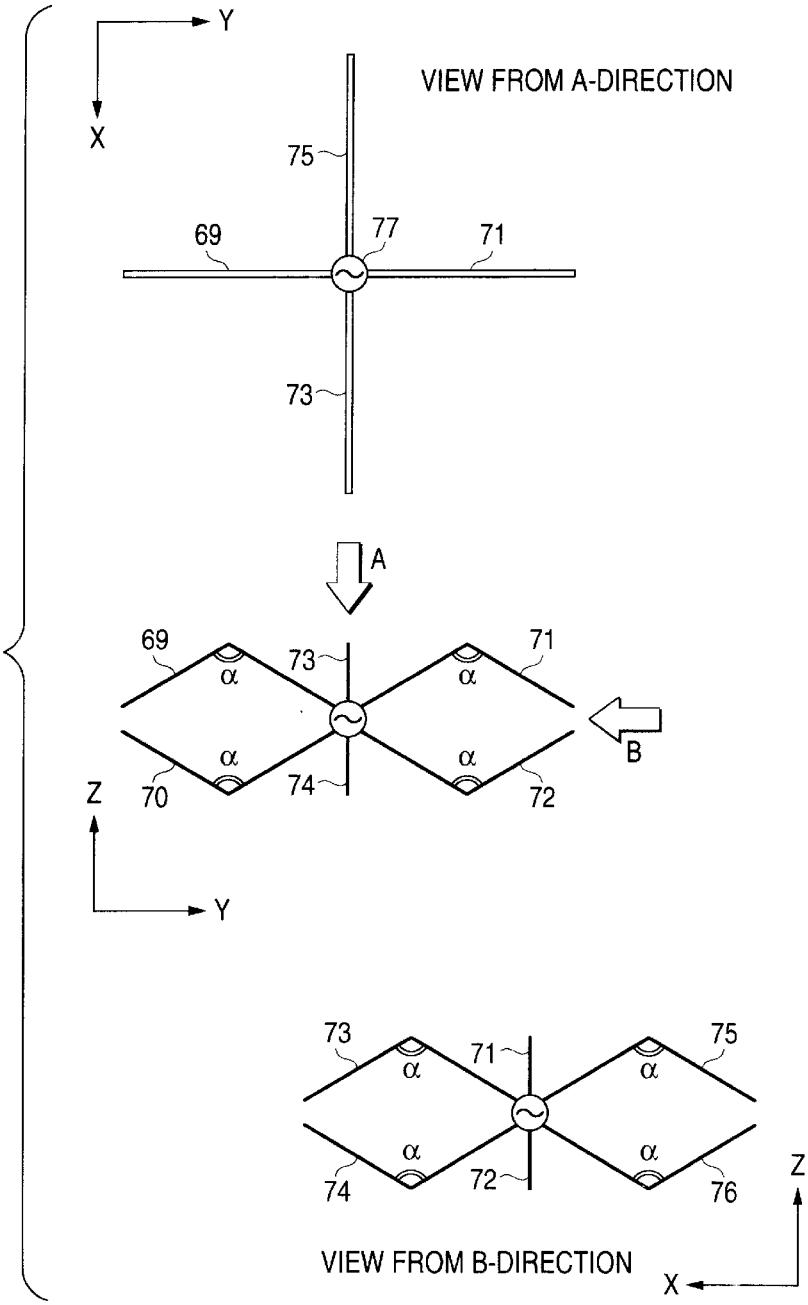

Referring to FIG. 14, an antenna device according to an eleventh embodiment of the present invention will be described below. FIG. 14 is a view showing the configuration of the antenna device according to the eleventh embodiment of the present invention. In FIG. 14, the reference numerals 69, 70, 71, 72, 73, 74, 75 and 76 designate antenna elements; and 77, a high-frequency signal source.

Referring to FIG. 14, the operation of the antenna device according to this embodiment will be described below. The feeding portion 77 and the antenna elements 69, 70 and 71, 72 operate in the same manner as in the antenna device according to the third embodiment in FIG. 6. The antenna elements 73, 74, and 75, 76 are connected in parallel to the antenna elements 69, 70 and 71, 72 so that the directions of main polarization are made identical with each other whereas the directions of main radiation cross perpendicularly to each other.

The antenna device configured as described above exhibits radiation characteristic in which the radiation directivity in the horizontal plane in terms of vertically polarized wave is concentrated into the four directions X, −X, Y and −Y. A gain of about 5.5 dB is obtained in each of the four directions. Radiation characteristic of about 30 degrees as a half-value width can be obtained.

Also in this embodiment, the directivity in the vertical plane and in the horizontal plane can be changed by changing the angle $\alpha$ in the bent portions.

As described above, in the antenna device according to the eleventh embodiment, a 4-directional antenna having desired directivity and having a high gain can be achieved with a simple configuration.

Twelfth Embodiment

Figure 15:
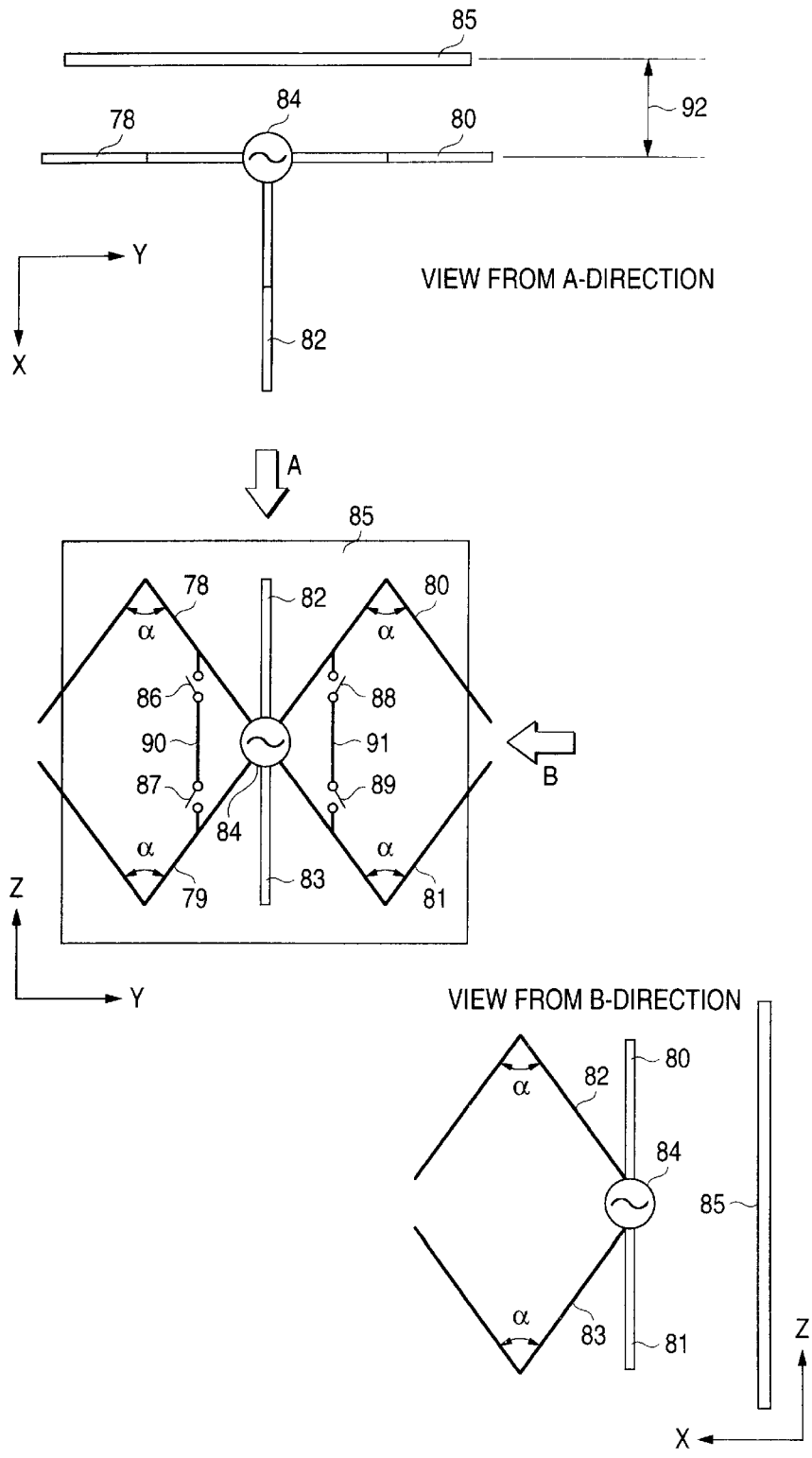

Referring to FIG. 15, an antenna device according to a twelfth embodiment of the present invention will be described below. FIG. 15 is a view showing the configuration of the antenna device according to the twelfth embodiment of the present invention. In FIG. 15, the reference numerals 78, 79, 80, 81, 82 and 83 designate antenna elements; 84, a feeding portion; 85, a reflection plate; 86, 87, 88 and 89, high-frequency switches; and 90 and 91, shorting lines.

Referring to FIG. 15, the configuration of the antenna device according to this embodiment will be described below in more detail. The antenna elements 78, 79 and 80, 81 and the feeding portion 84 operate in the same manner as in the antenna device according to the third embodiment in FIG. 6. The antenna elements 82 and 83 are connected in parallel to the antenna elements 78, 79 and 80, 81. The antenna elements are arranged so that the directions of main polarization are made identical with each other whereas the directions of main radiation cross perpendicularly to each other. The high-frequency switches 86 and 87 and the shorting line 90 are connected to the antenna elements 78 and 79 at points. When the high-frequency switches 86 and 87 are turned on, the antenna elements 78 and 79 and the shorting line 90 serve as a quarter-wavelength shorting stub in which the antenna elements do not contribute to radiation. The antenna elements 80 and 81, the high-frequency switches 88 and 89 and the shorting line 91 operate in the same manner as described above. Further, the reflection plate 85 is arranged so as to be separated by a distance 92 in the −X direction from the antenna elements 78, 79 and 80, 81.

Referring to FIG. 15, the operation of the antenna device according to this embodiment will be described below. In the antenna device configured as described above, when the high-frequency switches 86 and 87 are turned on while the high-frequency switches 88 and 89 are turned off, the antenna elements 78 and 79 do not contribute to radiation so that radiation is concentrated into an intermediate direction between the X direction and the Y direction. As a result, a gain of about 9 dB is obtained and radiation directivity of about 80 degrees as a half-value width is obtained. On the contrary, when the high-frequency switches 86 and 87 are turned off while the high-frequency switches 88 and 89 are turned on, the direction of maximum radiation is directed to the intermediate direction between the X direction and the −Y direction.

Also in this embodiment, the directivity in the vertical plane and in the horizontal plane can be changed by changing the angle $\alpha$ in the bent portions.

As described above, in the antenna device according to the twelfth embodiment, antenna elements opposite to each other are partially connected/disconnected to/from each other by electronic switches to thereby obtain desired directivity. Hence, a changeable directional antenna having a high gain can be achieved with a simple configuration.

Thirteenth Embodiment

Figure 16:
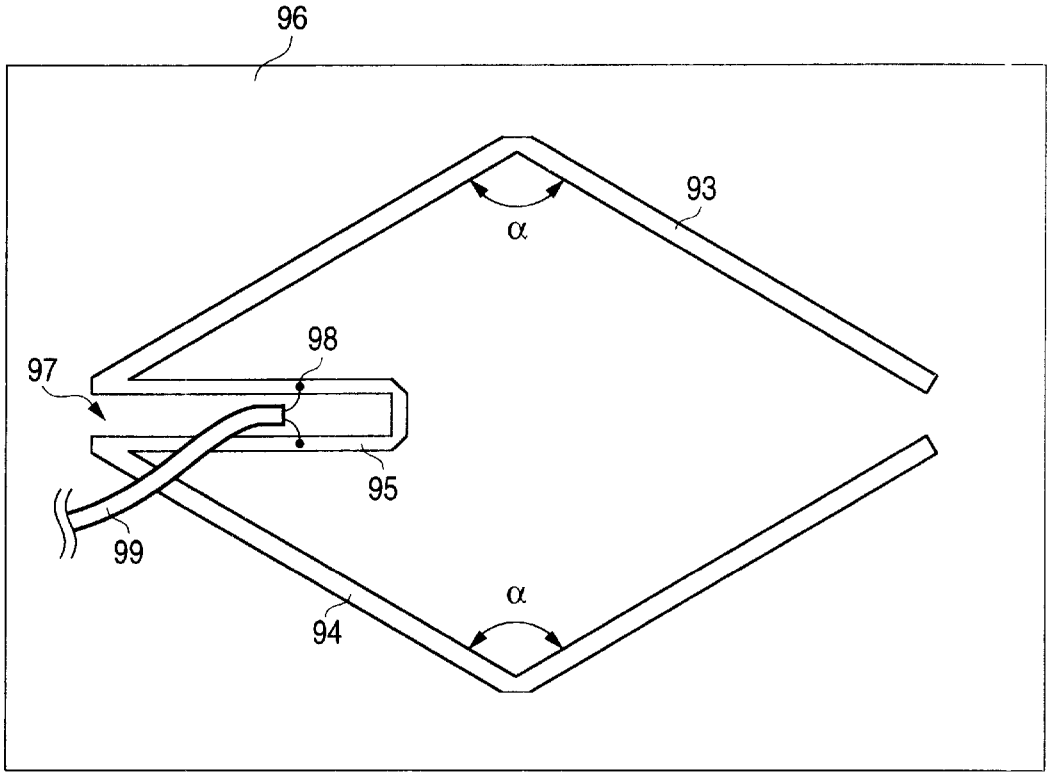

Referring to FIG. 16, an antenna device according to a thirteenth embodiment of the present invention will be described below. FIG. 16 is a view showing the configuration of the antenna device according to the thirteenth embodiment of the present invention. In FIG. 16, the reference numerals 93 and 94 designate antenna patterns (antenna elements); 95, a quarter-wavelength shorting stub; 96, a dielectric substrate; and 99, a high-frequency signal cable.

Referring to FIG. 16, the detailed configuration and operation of the antenna device according to the thirteenth embodiment of the present invention will be described below. The antenna patterns 93 and 94 and the quarter-wavelength shorting stub 95 are constituted by a print pattern formed on the dielectric substrate 96. The antenna patterns 93 and 94 operate in the same manner as in the antenna device according to the fourth embodiment in FIG. 7. Impedance in the feeding portion 97 between the antenna patterns 93 and 94 reaches a high value of several kΩ. To match this impedance with the impedance (generally 50Ω) in the high-frequency signal cable 99, the high-frequency signal cable 99 is connected to the quarter-wavelength shorting stub 95 at optimal positions 98.

On this occasion, the quarter-wavelength shorting stub 95 does not increase the total area of the antenna because the stub 95 is disposed inside the antenna patterns 93 and 94.

As described above, in the antenna device according to the thirteenth embodiment, a matching circuit is formed by the print pattern on the dielectric substrate. Hence, the antenna device can be achieved with a small-size and simple planar configuration.

Fourteenth Embodiment

Figure 17:
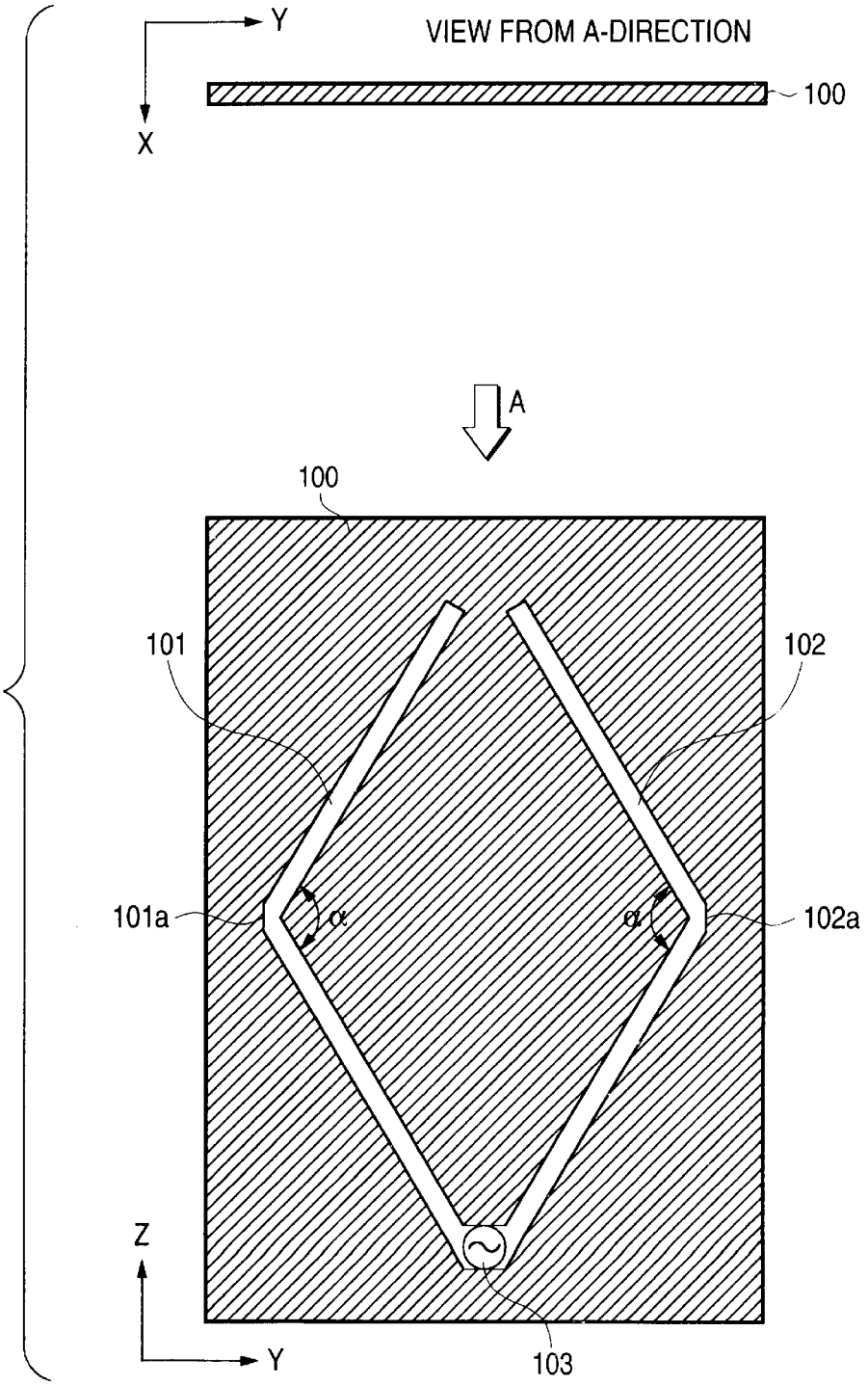

Referring to FIG. 17, an antenna device according to a fourteenth embodiment of the present invention will be described below. FIG. 17 is a view showing the configuration of the antenna device according to the fourteenth embodiment of the present invention. In FIG. 17, the reference numeral 100 designates a conductive plate; 101, a first slot element as an antenna element; 102, a second slot element as an antenna element; 101*a* and 102*a*, bent portions; and 103, a feeding portion.

The configuration of the antenna device according to this embodiment will be described in more detail. Each of the first and second slot elements 101 and 102 is constituted by an opening portion provided in the conductive plate 100. Each of the first and second slot elements 101 and 102 is formed to have a length equal to one wavelength. Further, the first and second slot elements 101 and 102 are bent at an angle α in the bent portions 101*a* and 102*a* respectively in the center. As shown in FIG. 17, the first and second slot elements 101 and 102 are arranged in diamond-wise opposition to each other. The length of each side of the diamond shape is equal to a half wavelength (λ/2). The respective opening portions of one-ends of the first and second slot elements 101 and 102 are connected to each other and a feeding portion 103 is provided at this junction. The respective opening portions at the other-ends are not connected to each other.

Referring to FIG. 17, the operation of the antenna device according to this embodiment will be described below. The antenna device configured as described above is complementary to the antenna device according to the first embodiment in FIG. 1. The operation of the antenna device of this embodiment can be explained in the same manner as that in the antenna device of the first embodiment if the electric currents distributed into the respective antenna elements in FIG. 1 are replaced by magnetic currents distributed into the respective slot elements in FIG. 17. Also in FIG. 17, vertically polarized wave is radiated. Maximum radiation is generated in the X direction and in the −X direction, so that a directional gain of about 6 dB is obtained. When the angle α in the bent portions is changed, radiation patterns in the horizontal plane and in the vertical plane can be changed greatly in the same manner as in the antenna device according to the first embodiment in FIG. 1. When, for example, the angle α in the bent portions is changed to increase from 30 degrees to 150 degrees, the half-value width of the radiation pattern in the horizontal plane changes from 40 degrees to 150 degrees whereas the half-value width of the radiation pattern in the vertical plane changes from 78 degrees to 58 degrees.

Although this embodiment has shown the case where the direction of main polarization is vertical (Z), the antenna device shown in FIG. 17 can also operate as a horizontal polarization antenna if the antenna device is arranged so as to be rotated by 90 degrees to thereby select the direction of main polarization to be horizontal (Y).

As described above, in the antenna device according to the fourteenth embodiment, a slot antenna having desired directivity and having a high gain can be achieved with a simple planar configuration.

Fifteenth Embodiment

Figure 18:
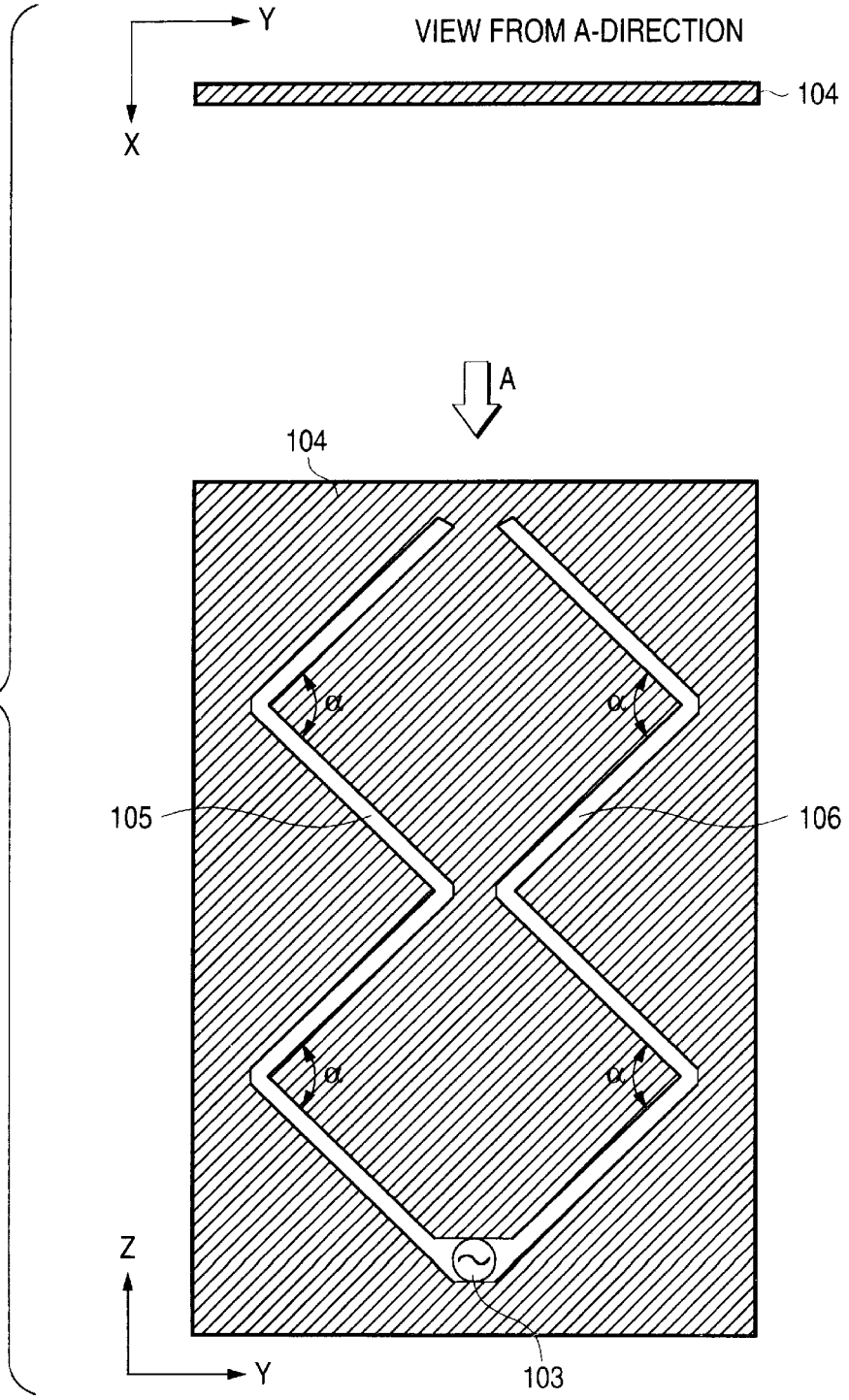

Referring to FIG. 18, an antenna device according to a fifteenth embodiment of the present invention will be described below. FIG. 18 is a view showing the configuration of the antenna device according to the fifteenth embodiment of the present invention. In FIG. 18, the reference numeral 103 designates a feeding portion; 104, a conductive plate; 105, a first slot element as an antenna element; and 106, a second slot element as an antenna element.

Referring to FIG. 18, the detailed configuration and operation of the antenna device according to the fifteenth embodiment of the present invention will be described below. Each of the first and second slot elements 105 and 106 is constituted by opening portions formed in the conductive plate 104. Each of the first and second slot elements 105 and 106 is formed to have a length equal to two wavelengths. Further, each of the first and second slot elements 105 and 106 is bent at an angle α in three places. The antenna device configured as described above is complementary to the antenna device according to the second embodiment in FIG. 5. In the antenna device shown in FIG. 17, vertically polarized wave is radiated, so that maximum radiation is generated in the X direction and in the −X direction. A directional gain of about 8.5 dB is obtained. When the angle α is changed, radiation patterns in the horizontal plane and in the vertical plane can be changed greatly in the same manner as in the antenna device according to the second embodiment in FIG. 5. When, for example, the angle α is made to increase from 60 degrees to 120 degrees, the half-value width of the radiation pattern in the horizontal plane changes from 50 degrees to 65 degrees whereas the half-value width of the radiation pattern in the vertical plane changes from 50 degrees to 35 degrees.

As described above, in the antenna device according to the fifteenth embodiment, a slot antenna having desired directivity and having a high gain can be achieved with a simple planar configuration.

Sixteenth Embodiment

Figure 19:
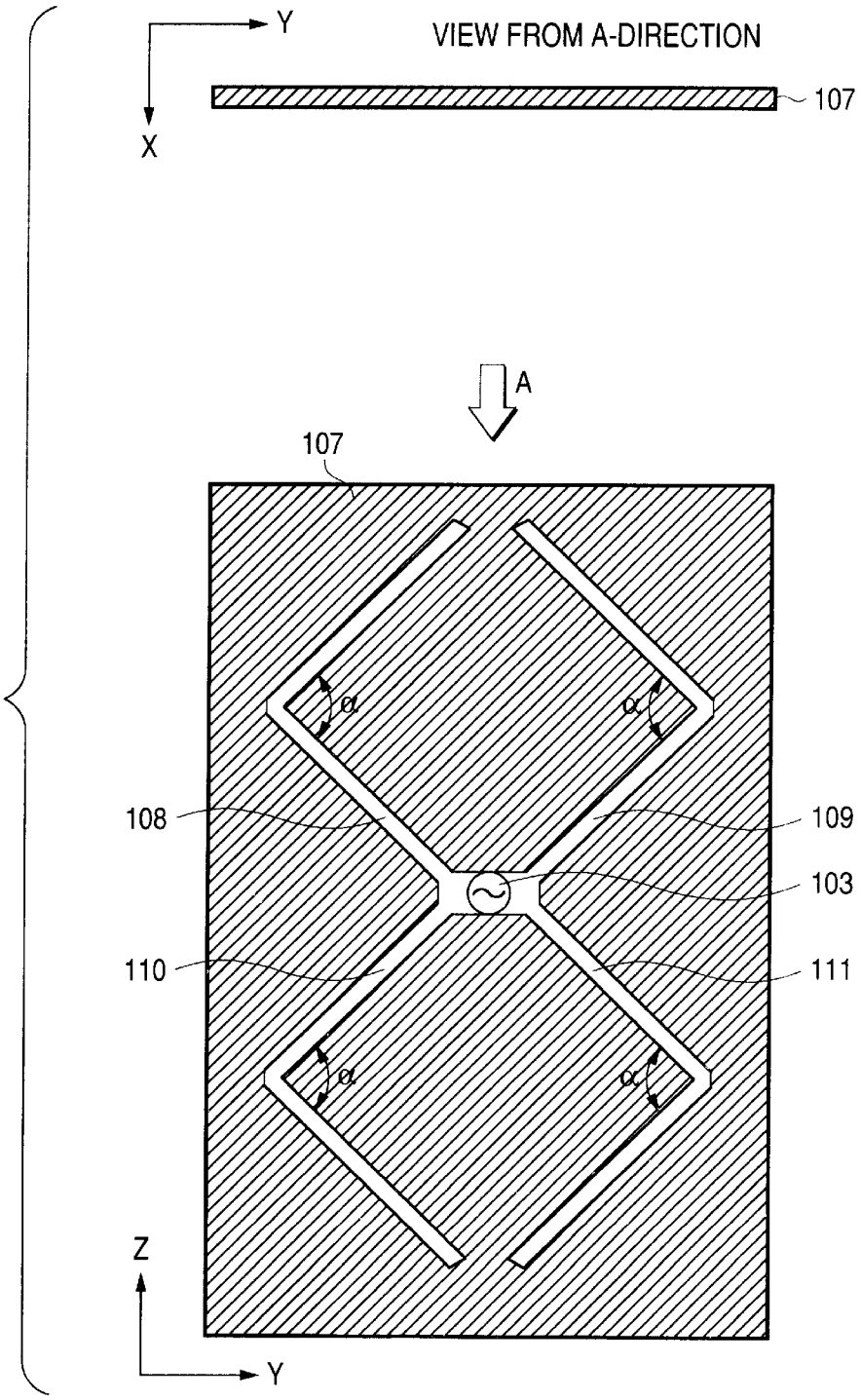

Referring to FIG. 19, an antenna device according to a sixteenth embodiment of the present invention will be described below. FIG. 19 is a view showing the configuration of the antenna device according to the sixteenth embodiment of the present invention. In FIG. 19, the reference numeral 103 designates a feeding portion; 107, a conductive plate; 108 and 110, first slot elements as antenna elements; and 109 and 111, second slot elements as antenna elements.

Referring to FIG. 19, the detailed configuration and operation of the antenna device according to the sixteenth embodiment of the present invention will be described below. The first slot elements 108 and 109 and the second slot elements 110 and 111 operate in the same manner as in the antenna device according to the fourteenth embodiment in FIG. 17 and are connected in parallel with each other at the feeding portion 103. The antenna device configured as shown in FIG. 19 is complementary to the antenna device according to the third embodiment shown in FIG. 6. In FIG. 19, vertically polarized wave is radiated, so that maximum radiation is generated in the X direction and in the −X direction. A directional gain of about 9 dB is obtained. When the angle $\alpha$ is changed, radiation patterns in the horizontal plane and in the vertical plane can be changed greatly in the same manner as in the antenna device according to the third embodiment shown in FIG. 6.

Incidentally, although this embodiment has shown the case where two pairs of antenna devices according to the fourteenth embodiment shown in FIG. 17 are connected in parallel with each other, the directivity in the vertical plane can be narrowed to obtain a higher directional gain if two pairs of antenna devices according to the fifteenth embodiment shown in FIG. 18 are connected in parallel with each other.

As described above, in the antenna device according to the sixteenth embodiment, a slot antenna having desired directivity and having a high gain can be achieved with a simple planar configuration.

Seventeenth Embodiment

Figure 20:
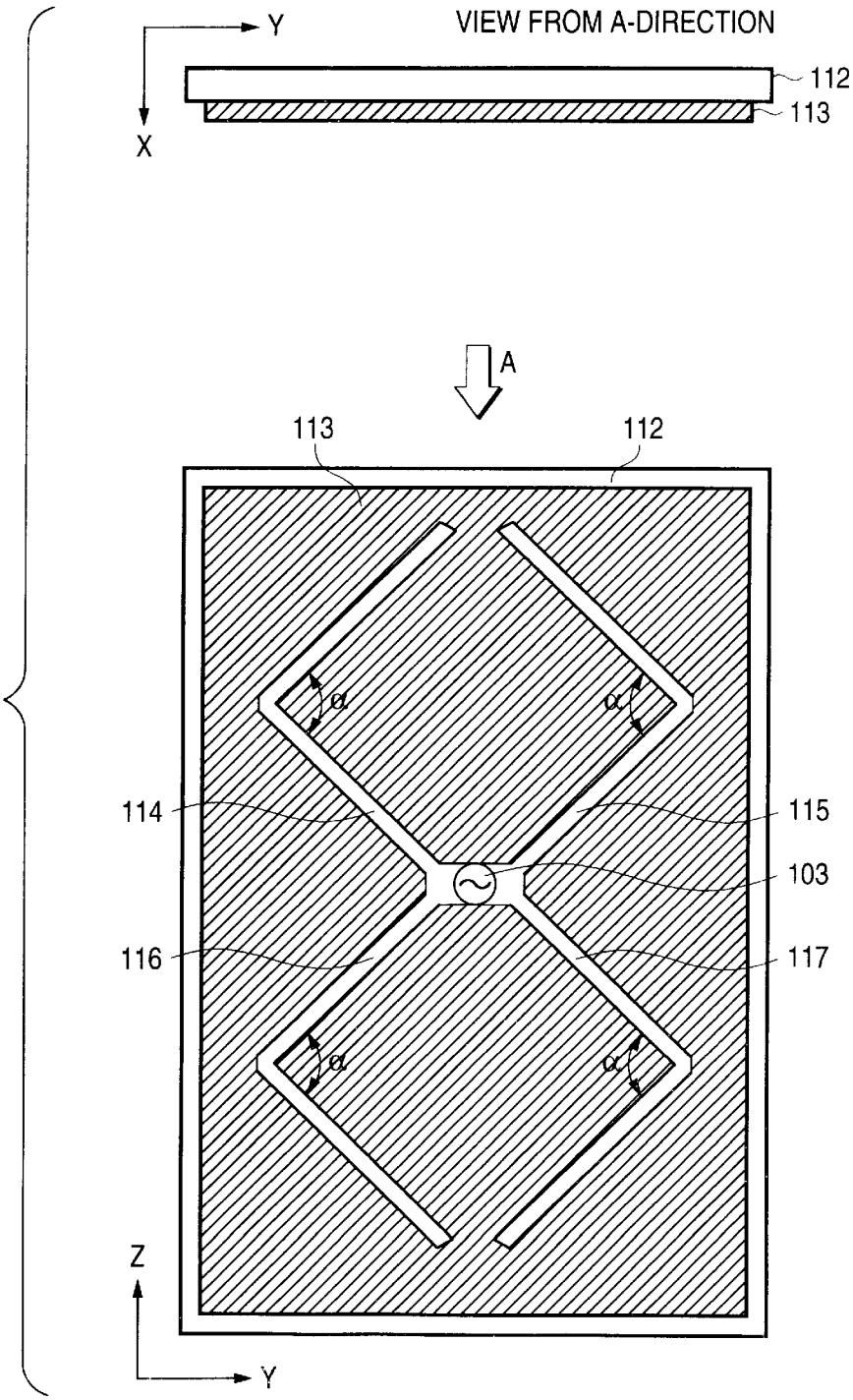

Referring to FIG. 20, an antenna device according to a seventeenth embodiment of the present invention will be described below. FIG. 20 is a view showing the configuration of the antenna device according to the seventeenth embodiment of the present invention. In FIG. 20, the reference numeral 103 designates a feeding portion; 112, a dielectric substrate; 113, a conductor pattern; and 114, 115, 116 and 117, slot elements as antenna elements.

Referring to FIG. 20, the detailed configuration and operation of the antenna device according to the seventeenth embodiment of the present invention will be described below. The conductor pattern 113 is constituted by a print pattern formed on the dielectric substrate 112. The slot elements 114, 115, 116 and 117 are constituted by opening portions provided in the conductor pattern 113. When, for example, the effective relative dielectric constant of the dielectric substrate 112 is 2, the length of each of the slot elements 114, 115, 116 and 117 is reduced to about a half as large as the length of corresponding one of the first and second slot elements 108, 109, 110 and 111 in the antenna device shown in FIG. 19 because the wavelength on the dielectric substrate 112 is reduced to about a half as large as the wavelength in a free space. The antenna device configured as described above operates in the same manner as the antenna device shown in FIG. 19.

Incidentally, also in this embodiment, radiation patterns in the horizontal plane and in the vertical plane can be controlled by changing the angle $\alpha$ in the bent portions. As described above, in the antenna device according to the seventeenth embodiment, a slot antenna having desired directivity and having a high gain can be achieved with a small-size and simple planar configuration.

Eighteenth Embodiment

Figure 21:
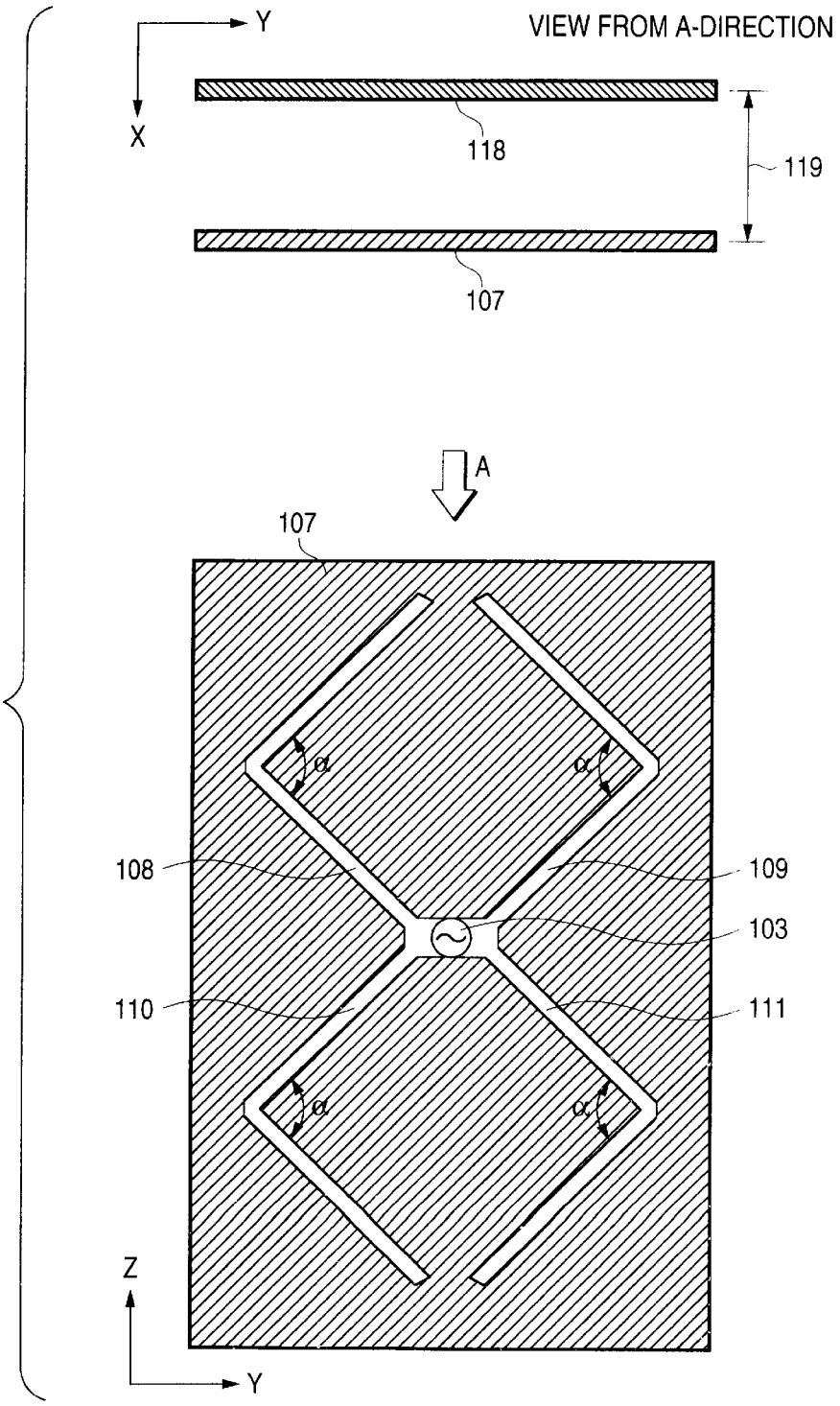

Referring to FIG. 21, an antenna device according to an eighteenth embodiment of the present invention will be described below. FIG. 21 is a view showing the configuration of the antenna device according to the eighteenth embodiment of the present invention. In FIG. 21, the reference numeral 103 designates a feeding portion; 107, a conductive plate; 108 and 110, first slot elements as antenna elements; 109 and 111, second slot elements as antenna elements; and 118, a reflection plate.

Referring to FIG. 21, the detailed configuration and operation of the antenna device according to the eighteenth embodiment of the present invention will be described below. The conductive plate 107, the first and second slot elements 108, 109, 110 and 111 and the feeding portion 103 operate in the same manner as in the antenna device according to the sixteenth embodiment shown in FIG. 19. The reflection plate 118 is arranged so as to be separated by a distance 119 in the −X direction from the conductive plate 107.

The conductive plate 107, the first and second slot elements 108, 109, 110 and 111 and the feeding portion 103 generate maximum radiation in the X direction and in the −X direction. Wave radiated in the −X direction is reflected by the reflection plate 118, so that the reflected wave is radiated in the X direction. Hence, radiation patterns are concentrated into the X direction. When the distance 119 of the reflection plate 118 is selected to be about $0.3\lambda$ (0.3 times as large as the wavelength), a directional gain of about 12.5 dB can be obtained in the X direction.

Incidentally, also in this embodiment, radiation patterns in the horizontal plane and in the vertical plane can be controlled by changing the angle $\alpha$ in the bent portions.

As described above, in the antenna device according to the eighteenth embodiment, a slot antenna having desired directivity and having a high gain can be achieved with a simple planar configuration.

Nineteenth Embodiment

Figure 22:
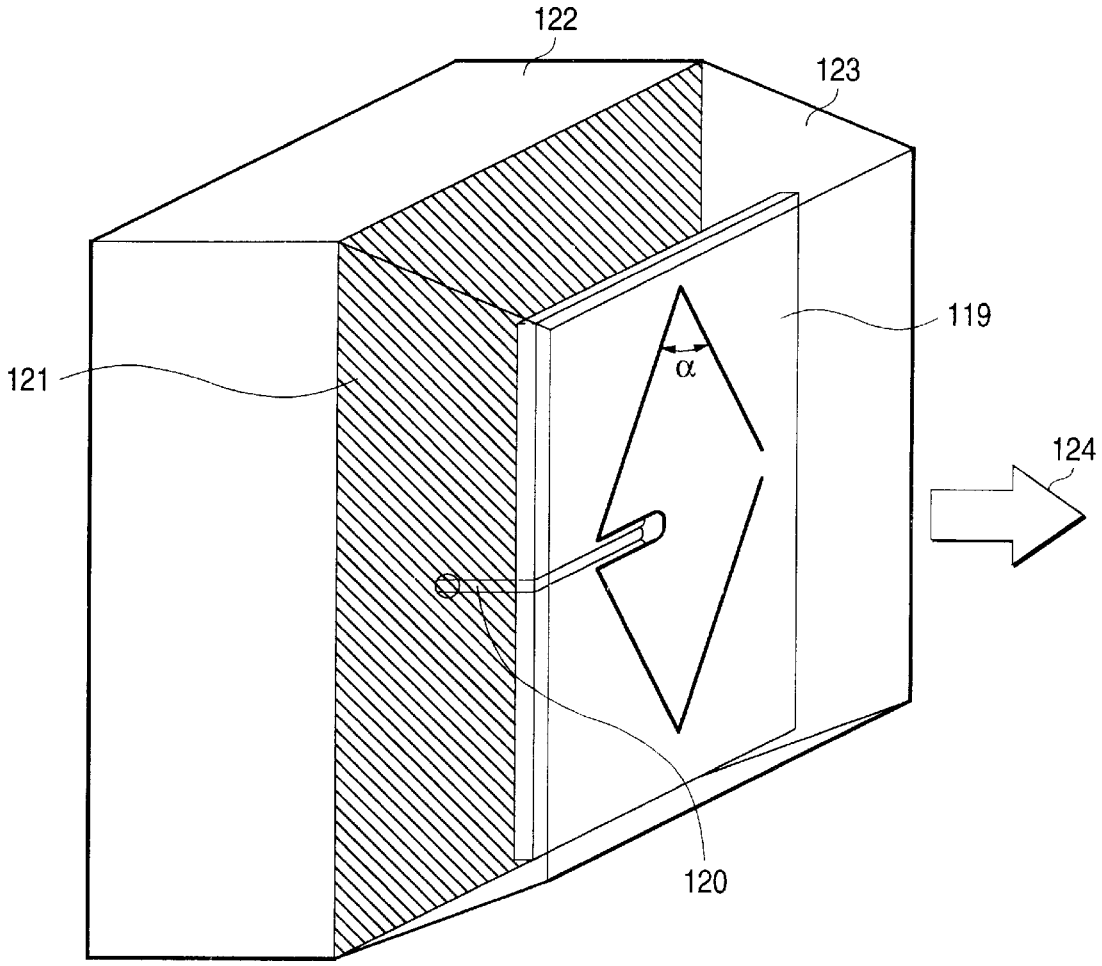

Referring to FIG. 22, a radio apparatus with an antenna device configured according to a nineteenth embodiment of the present invention will be described below. FIG. 22 is a view showing the configuration of the antenna device according to the nineteenth embodiment of the present invention. In FIG. 22, the reference numeral 119 designates an antenna device; 120, a high-frequency cable; 121, a reflection plate; 122, a radio circuit portion; and 123, an antenna cover.

The configuration of the radio apparatus according to this embodiment will be described below in more detail. The reflection plate 121 is disposed on one side surface of the radio circuit portion 122. The antenna device 119 is disposed so as to be separated by a fixed distance (for example, $0.3\lambda$) from the reflection plate 121. The high-frequency cable 120 is connected from the radio circuit portion 122 to the antenna device 119 so that the antenna device 119 is fed. The antenna device 119 is protected by the antenna cover 123. The antenna device 119 operates in the same manner as the antenna device according to the thirteenth embodiment shown in FIG. 16.

Referring to FIG. 22, the operation of the radio apparatus according to this embodiment will be described below. In the radio apparatus configured as described above, radiation from the antenna device 119 is concentrated into the direction of the arrow 124 by the reflection plate 121. Thus, a directional gain of about 9.5 dB can be obtained. Hence, antenna characteristic is not affected by the radio circuit portion 122. Further, the radio circuit portion 122 is not affected by electric wave radiated from the antenna device 119.

Further, it is sufficient if the distance between the reflection plate 121 and the antenna device 119 is about 0.3λ (about 45 mm for the operating frequency of 1900 MHz). Accordingly, the radio apparatus having the built-in antenna can be made compact. Hence, if the radio apparatus is applied to a fixed terminal equipment or to a radio base station, desired radiation directivity can be obtained with a small-size and simple configuration. Hence, a fixed terminal equipment or a radio base station with a built-in antenna having a high gain can be achieved.

Incidentally, the configuration of the radio apparatus and the antenna device is not limited to this embodiment and the same effect as described above can be obtained if the same structure as described above is provided.

As described above, in the radio apparatus according to the nineteenth embodiment, a radio apparatus with a built-in antenna having desired directivity and having a high gain can be achieved with a small-size and simple configuration.

Twentieth Embodiment

Figure 23:
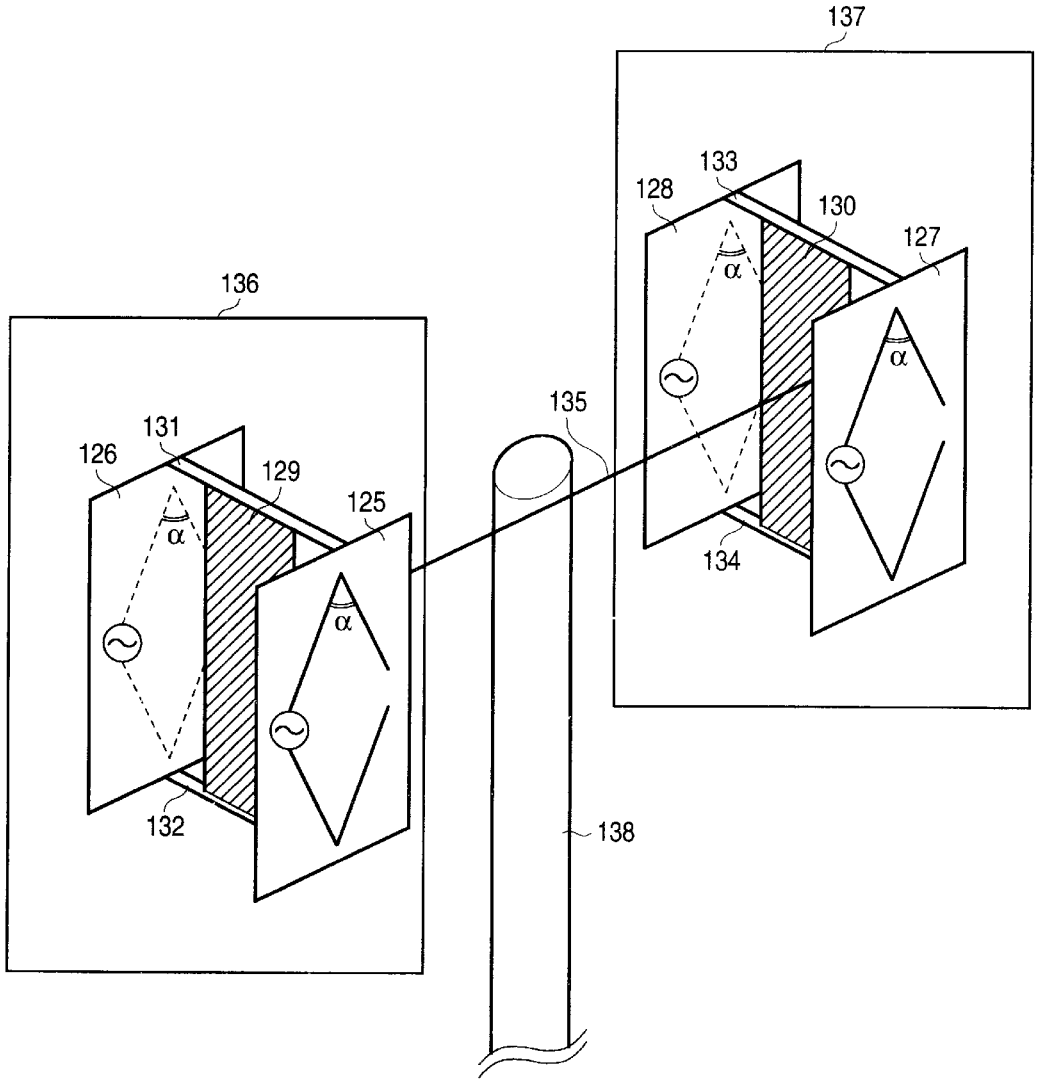

Referring to FIG. 23, an antenna device according to a twentieth embodiment of the present invention will be described below. FIG. 23 is a view showing the configuration of the antenna device according to the twentieth embodiment of the present invention. In FIG. 23, the reference numerals 125, 126, 127 and 128 designate antenna devices; 129 and 130, reflection plates; 131, 132, 133, 134 and 135, fittings; 136, a first antenna system; 137, a second antenna system; and 138, a pole.

Referring to FIG. 23, the detailed configuration and operation of the antenna device according to the twentieth embodiment of the present invention will be described below. The antenna devices 125, 126, 127 and 128 operate in the same manner as the antenna device according to the thirteenth embodiment shown in FIG. 16. The antenna devices 125 and 126 are arranged in 180 degrees-opposition to each other through the reflection plate 129 and fixed by the fittings 131 and 132. Thus, a first antenna system 136 is formed. Similarly, the antenna devices 127 and 128 are arranged in 180 degrees-opposition to each other through the reflection plate 130 and fixed by the fittings 133 and 134. Thus, a second antenna system 137 is formed. The first and second antenna systems 136 and 137 are fixed to each other by the fittings 135 so as to be separated by a fixed distance (generally a distance of one wavelength or larger) from each other, so that they serve as a diversity antenna.

Here, in the first antenna system 136, the antenna device 125 exhibits radiation directivity of about 180 degrees as a half-value width in the X direction because of the effect of the reflection plate 129, so that the gain in the −X direction becomes lower by about 10 dB than the gain in the X direction. On the other hand, the antenna device 126 exhibits radiation directivity of about 180 degrees as a half-value width in the −X direction because of the effect of the reflection plate 129, so that the gain in the X direction becomes lower by about 10 dB than the gain in the −X direction. As described above, the reflection plate 129 is used in common to the antenna devices 125 and 126. Also the second antenna system 137 operates in the same manner as the first antenna system 136.

Incidentally, the antenna device and the arrangement and configuration thereof are not limited to this embodiment and the same effect as described above can be obtained if the same structure as described above is provided.

As described above, in the antenna device according to the twentieth embodiment, a sector diversity antenna constituted by a plurality of antennas arranged therein and having a high gain with desired directivity can be achieved with a small-size and simple configuration.

INDUSTRIAL APPLICABILITY

According to the present invention, an antenna device configured as described above particularly has two antenna devices arranged in diamond-wise opposition to each other so that one-end of each antenna element is fed whereas the other-end of the antenna element is opened. Each of the antenna elements of the antenna device is bent at an angle α in its center to there by select the angle α to be an angle at which optimal radiation directivity can be obtained. Hence, desired optimal radiation directivity can be obtained with a simple planar configuration. Hence, an antenna device having a high gain can be achieved.

Further, according to the present invention, also in the case where antenna elements are particularly constituted by a print pattern on a dielectric substrate, desired radiation directivity can be obtained with a small-size and simple planar configuration. Hence, an antenna device having a high gain can be achieved.

Further, according to the present invention, two pairs of antenna devices are particularly arranged with the directions of main polarization crossing perpendicularly to each other so that the two pairs of antenna devices are fed with their phases which are different by 90 degrees from each other. Hence, the desired radiation directivity can be obtained with a simple planar configuration. Hence, a circular polarization antenna having a high gain can be achieved.

Further, according to the present invention, a plurality of antenna devices are particularly arranged with the directions of main polarization being made identical with each other and with the directions of main radiation being made different from each other so that opposite antenna elements in one or plural antenna devices are partially electronically connected/disconnected to/from each other. Hence, the radiation directivity can be changed variously to obtain desired directivity with a simple configuration. Hence, a changeable directional antenna device having a high gain can be obtained.

Further, according to the present invention, a quarter-wavelength shorting stub is particularly connected to feeding points so that feeding is performed at a position where the impedance of the shorting stub is optimized. Hence, good impedance matching can be obtained by a small-size matching circuit with a simple configuration. Hence, an antenna device having a high gain can be provided.

Further, according to the present invention, an antenna device particularly has slot elements provided in two conductive plates and arranged in diamond-wise opposition to each other so that one-end of each slot element is fed whereas the other-end of the slot element is opened. Each of the slot elements of the antenna device is bent at an angle α in its center to thereby select the angle α to be an angle at which optimal radiation directivity can be obtained. Hence, desired radiation directivity can be obtained with a simple planar configuration. Hence, a slot antenna having a high gain can be achieved.

Further, according to the present invention, a radio apparatus has a built-in antenna device in which two antenna elements are arranged in diamond-wise opposition to each other so that one-end of each antenna element is fed whereas the other-end of the antenna element is opened. Each of the antenna elements of the antenna device is bent at an angle α in its center to thereby select the angle α to be an angle at which optimal radiation directivity can be obtained. Hence, a radio apparatus having a built-in antenna with desired directivity and a high gain with a small-size and simple configuration can be provided.

Further, according to the present invention, particularly one reflection plate is used in common to a plurality of antenna devices. Hence, desired radiation directivity can be obtained with a small-size and simple configuration. Hence, a diversity or sector antenna having a high gain can be achieved.

Further, according to the present invention, particularly a radio apparatus with a built-in antenna device according to any one of embodiments of the present invention is mounted. Hence, desired radiation directivity can be obtained in a small-size and simple configuration. Hence, a diversity or sector antenna having a high gain can be used in a radio base station.

What is claimed is:

1. A plurality of antenna devices, each antenna device comprising a first one-wavelength antenna element bent at an angle $\alpha$ in a center of said first antenna element, and a second one-wavelength antenna element bent at an angle $\alpha$ in a center of said second antenna element, wherein said first and second antenna elements are arranged in diamond-wise opposition to each other, wherein a feeding portion is disposed at one-end of said first and second antenna elements, wherein another end of said first and second antenna elements is open, and wherein said angle $\alpha$ is selected to be an optimal angle, wherein said plurality of antenna devices are arranged such that directions of main polarization of each antenna device are made identical with each other while directions of main radiation are made different from each other, and still further wherein opposite antenna elements of at least one antenna device among said plurality of antenna devices are partially electronically connected/disconnected to/from each other.

* * * * *

UNITED STATES PATENT AND TRADEMARK OFFICE

CERTIFICATE OF CORRECTION

PATENT NO. : 6,573,874 B1
DATED : June 3, 2003
INVENTOR(S) : Yutaka Saito et al.

It is certified that error appears in the above-identified patent and that said Letters Patent is hereby corrected as shown below:

Column 5,
Line 3, please delete “angle a in”, and insert therefor -- angle α in --.

Column 15,
Line 11, please delete “circulr lypolarized”, and insert therefor -- circularly polarized --.

Signed and Sealed this

Twelfth Day of August, 2003

JAMES E. ROGAN
*Director of the United States Patent and Trademark Office*